US010393421B2

(12) United States Patent
Lee et al.

(10) Patent No.: US 10,393,421 B2
(45) Date of Patent: Aug. 27, 2019

(54) ICE MAKER AND REFRIGERATOR HAVING THE SAME

(71) Applicant: Samsung Electronics Co., Ltd, Gyeonggi-do (KR)

(72) Inventors: Jae Jin Lee, Gyeonggi-do (KR); Jin Jeong, Gyeonggi-do (KR); Do Yun Jang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 282 days.

(21) Appl. No.: 15/390,458

(22) Filed: Dec. 23, 2016

(65) Prior Publication Data

US 2017/0292751 A1 Oct. 12, 2017

(30) Foreign Application Priority Data

Dec. 24, 2015 (KR) ..... 10-2015-0186061

(51) Int. Cl.

| | |
|---|---|
| ***F25C 5/18*** | (2018.01) |
| ***F25C 5/182*** | (2018.01) |
| ***F25C 5/04*** | (2006.01) |
| ***F25C 5/20*** | (2018.01) |

(52) U.S. Cl.

CPC ..... *F25C 5/182* (2013.01); *F25C 5/046* (2013.01); *F25C 5/22* (2018.01); *F25C 2500/02* (2013.01)

(58) Field of Classification Search

CPC ..... F25C 5/005; F25C 5/182; F25C 5/046; F25C 5/22; F25C 1/147

See application file for complete search history.

(56) References Cited

U.S. PATENT DOCUMENTS

| | | | | |
|---|---|---|---|---|
| 5,050,777 | A | 9/1991 | Buchser | |
| 6,109,476 | A | 8/2000 | Thompson et al. | |
| 2006/0090496 | A1 | 5/2006 | Adamski et al. | |
| 2006/0272347 | A1 | 12/2006 | Park | |
| 2008/0053138 | A1 | 3/2008 | Ryu et al. | |
| 2009/0293529 | A1 * | 12/2009 | Shinohara | F25C 5/22 62/344 |
| 2013/0174596 | A1 | 7/2013 | Kim et al. | |

(Continued)

FOREIGN PATENT DOCUMENTS

| | | | |
|---|---|---|---|
| CN | 1873353 | A | 12/2006 |
| KR | 20130020530 | A * | 2/2013 |

(Continued)

OTHER PUBLICATIONS

One foreign reference (KR 20130020530 A) is attached, other file attached (translation of KR20130020530A) is the translation of KR 20130020530 A.*

(Continued)

*Primary Examiner* — Keith M Raymond
*Assistant Examiner* — Kamran Tavakoldavani

(57) ABSTRACT

In an ice maker according to the present disclosure, transporter configured to supply ice to a dispenser, at least a part of which is located above an ice bucket located in the middle of the main body, may transport the ice upward to help the user take the ice conveniently even with the ice bucket located in the middle of the main body. So a refrigerator including the ice maker, according to the present disclosure, includes a storeroom to store groceries with increased utilization of the storeroom.

19 Claims, 18 Drawing Sheets

(56) References Cited

U.S. PATENT DOCUMENTS

| | | | | |
|---|---|---|---|---|
| 2013/0305763 | A1 | 11/2013 | Nuss | |
| 2014/0345313 | A1* | 11/2014 | Jeong | F25C 5/046 62/320 |
| 2016/0061509 | A1 | 3/2016 | Kim et al. | |

FOREIGN PATENT DOCUMENTS

| | | | | |
|---|---|---|---|---|
| KR | 20130020530 | A | * | 2/2013 |
| KR | 1020130020530 | | | 2/2013 |
| KR | 20130081136 | A | | 7/2013 |
| KR | 1020130142613 | | | 12/2013 |
| KR | 1020140049845 | | | 4/2014 |
| KR | 1020140125688 | | | 10/2014 |
| KR | 20140139282 | A | | 12/2014 |

OTHER PUBLICATIONS

European Search Report dated Apr. 24, 2017 in connection with European Patent Application No. 16 20 4171.

Office Action dated Nov. 16, 2018 in connection with Chinese Patent Application No. 201611215045.6, 9 pages.

China National Intellectual Property Administration, "Notification of the Second Office Action," Application No. 201611215045.6, dated Apr. 24, 2019, 15 pages.

European Patent Office, "Communication pursuant to Article 94(3) EPC," Application No. EP16204171.9, dated Apr. 17, 2019, 7 pages.

* cited by examiner

ICE MAKER AND REFRIGERATOR HAVING THE SAME

CROSS-REFERENCE TO RELATED APPLICATION(S) AND CLAIM OF PRIORITY

The present application is related to and claims priority to and the benefit of Korean Patent Application No. 10-2015-0186061, filed on Dec. 24, 2016, the disclosures of which is incorporated herein by reference in its entirety.

TECHNICAL FIELD

The present disclosure relates to an ice maker and refrigerator having the same.

BACKGROUND

Refrigerators are home appliances having a main body with storerooms and a cold air supply system for supplying cold air into the storerooms, to keep food and groceries fresh. The storerooms include a fridge maintained at temperatures of about 0 to 5 degrees Celsius for keeping groceries cool, and freezer maintained at temperatures of about 0 to −30 degrees in Celsius for keeping groceries frozen.

The refrigerators may be divided by the positions of the fridge and freezer into bottom mounted freezer (BMF) type refrigerators with the freezer located below while the fridge located above, top mounted freezer (TMF) type refrigerators with the freezer located above while the fridge located below, and side by side (SBS) type refrigerators with the freezer and fridge located in parallel in the left-and-right direction. Further, depending on the number of doors, they may further be divided into two-door, three-door, four-door refrigerators, and so on.

The refrigerator may be equipped with an ice maker for forming ice, and a dispenser for providing the ice formed by the ice maker out of the main body.

As for the BMF type refrigerator in particular, if the BMF type refrigerator is equipped with the ice maker and dispenser, an ice maker room is commonly partitioned off from the fridge at the upper corner of the fridge and the ice maker is arranged in the ice maker room. With this arrangement, the fridge fails to be cube-shaped, which causes inefficient space utilization.

If the ice maker room would be arranged in the freezer to address the problem, the dispenser for providing ice formed in the ice maker room needs to be located in a low position, causing inconvenience to the user.

SUMMARY

To address the above-discussed deficiencies, it is a primary object to provide a refrigerator having a storeroom to store groceries with increased utilization of the storeroom.

The present disclosure also provides a refrigerator including a transporter to make it easy for the ice in an ice bucket to be transported to a dispenser located above the ice bucket for convenience of the user.

In accordance with one aspect of the present disclosure, an ice maker includes an ice making unit configured to form ice, an ice bucket arranged below the ice making unit configured to store the ice formed by the ice making unit and a transporter configured to transport the ice stored in the ice bucket to an outside of the ice bucket.

Here, the transporter includes a first transporter configured to be rotationally arranged inside the ice bucket to transport the ice in a direction of a rotation shaft, and a second transporter including a blade to crush the ice transported by the first transporter by rotation, and configured to transport the ice to a top of the ice bucket as the blade rotates.

Also, the first and second transporters each include respective shafts configured to turn in different directions and rotate around the shafts.

Also, the blade comprises a first settler arranged on one side of the blade and configured to settle the ice in order for the ice to be transported to the top of the ice bucket while rotating along with the blade, and a second settler arranged on the other side of the blade and configured to settle the ice in order for the ice to be transported to the top of the ice bucket while rotating along with the blade.

Also the blade is able to rotate in a direction for the ice settled in the first settler to be transported upward, and is able to rotate in an opposite direction for the ice settled in the second settler to be transported upward.

Also, an angle formed between a direction in which the blade rotates and a direction in which the rotation shaft of the first transporter is arranged is between about 20 to about 50 degrees from a vertical direction of the ice bucket.

Also, the second transporter is arranged to be slanted upward to the first transporter.

Also the first transporter comprises a first driving motor configured to rotate the first transporter, the second transporter comprises a second driving motor configured to rotate the second transporter, and the first and second driving motors are driven independently.

Also the second transporter includes a case covering the blade, an inlet through which the ice transported by the first transporter comes, and an outlet formed at a location higher than the inlet and configured to discharge the ice.

Also the second transporter includes a fixed blade arranged in a rotation path of the opposite direction of the blade and configured to crush the ice transported in the opposite direction, and the ice transported in the opposite direction is crushed and discharged through the outlet.

Also the case further comprises an auxiliary outlet formed for discharging the ice falling in the rotation path of the opposite direction to prevent some of the crushed ice from falling before reaching the outlet and not being discharged.

Also a hub of a tapered form slanted toward the outlet is arranged on the rotation shaft of the blade.

Also the hub comprises a guide plane slanted toward the outlet and configured to guide the ice transported to the outlet to be discharged through the outlet.

Also the case further comprises a lift guide having a curved plane to guide the ice coming through the inlet to be transported upward in one direction or in an opposite direction, and arranged to be adjacent to the inlet.

Also the ice maker further includes an ice lifter arranged on an internal bottom of the ice bucket for lifting ice stored in the ice bucket to transport the ice by the first transporter.

In accordance with another aspect of the present disclosure, a refrigerator includes a main body including an opening on a front, a door including a dispenser and configured to open and close the opening, an ice making unit arranged inside the main body, an ice bucket configured to store ice formed by the ice making unit and a transporter configured to transport the ice stored in the ice bucket to the dispenser.

Here, the transporter includes an auger configured to be rotationally arranged inside the ice bucket for transporting the stored ice along a direction of a rotation shaft, and a blade unit configured to be rotationally arranged between the auger and the dispenser for transporting the ice transported by the auger to the dispenser by rotation, the auger and the blade unit are arranged to include different rotation shafts.

Also the auger is configured to transport the ice in a direction perpendicular to a direction in which the auger rotates, and the blade unit is configured to transport the ice in a direction of rotation.

Also the blade unit includes a blade configured to settle the ice stored in the ice bucket to be transported upward, and rotate along with the ice upward from a bottom of the ice bucket, and a case covering the blade, an inlet through which the ice transported by the auger comes and an outlet formed at a location higher than the inlet for discharging the ice.

Also the dispenser comprises a takeout hole of an opening form formed for the ice discharged from the outlet to come into the dispenser, and the blade unit comprises a slider to link the outlet and the takeout hole for the ice discharged from the outlet to slide to the takeout hole.

Also the slider comprises an open/close member arranged on a side adjacent to the takeout hole and configured to open or close the slider by pivoting itself, and the dispenser comprises an open/close projection protruding toward the open/close member from a bottom of the door is configured to press the open/close member to be pivoted.

Here, the open/close projection is configured to press the open/close member to be pivoted when the door is closed, thereby opening the slider.

In accordance with the other aspect of the present disclosure, an refrigerator includes a main body including an opening on a front, a door including a dispenser and configured to open and close the opening, an ice making unit arranged inside the main body, an ice bucket configured to store ice formed by the ice making unit and a first transporter arranged inside the ice bucket and configured to transport the ice stored in the ice bucket forward by rotation and a second transporter arranged between the first transporter and the dispenser configured to move the ice transported by the first transporter to the dispenser.

Here, the second transporter includes a blade arranged to be slanted upward with respect to the first transporter to move the ice stored in the ice bucket upward.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
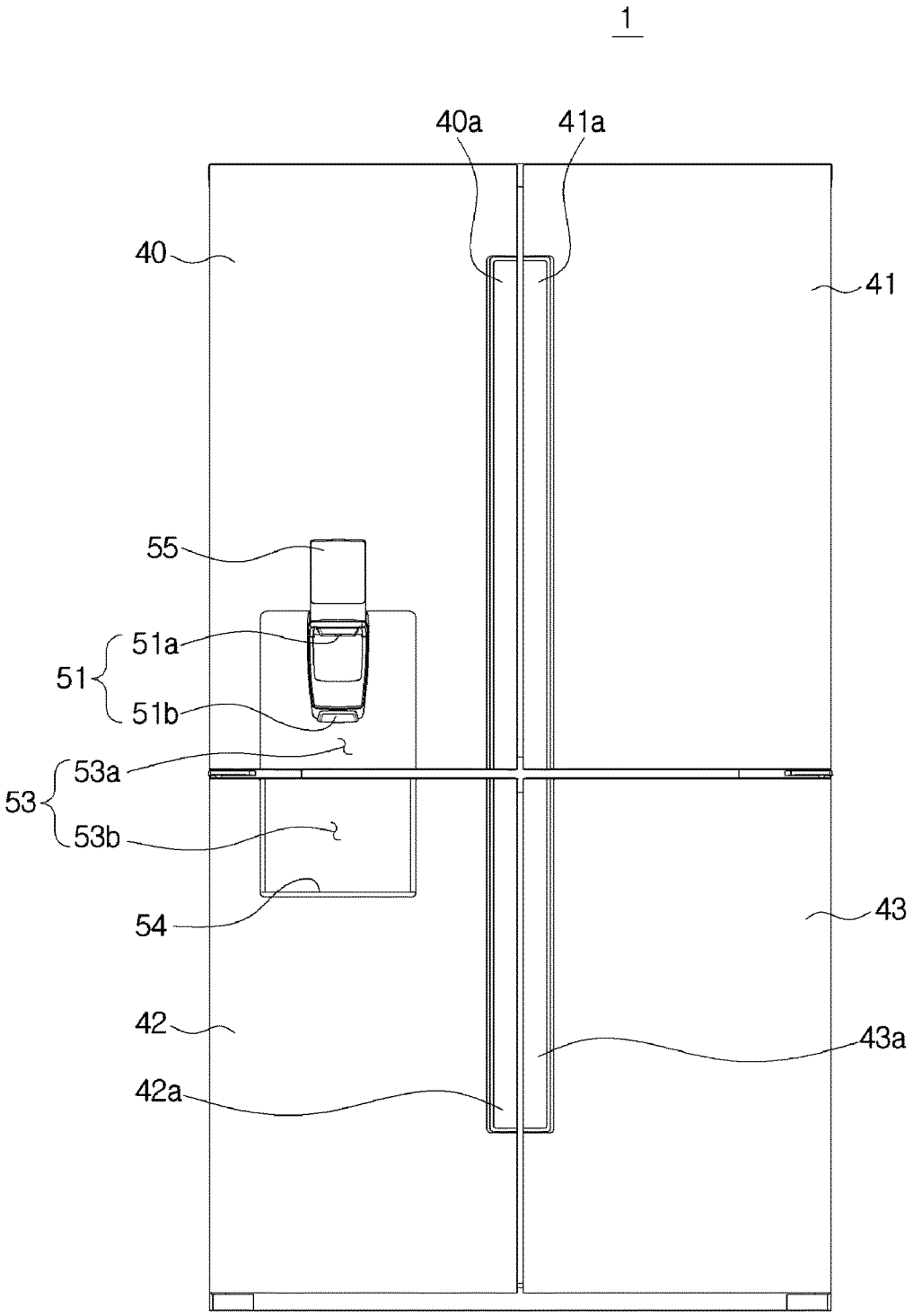
FIG. 1 illustrates a front view showing a refrigerator according to various embodiments of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Embodiments of the present disclosure are examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

In the drawings, well-known or unrelated components may be omitted for clarity and conciseness, and some components may be enlarged or exaggerated in terms of their dimensions or the like for better understanding.

Unless otherwise defined, all terms including technical and scientific terms used herein have the same meaning as commonly understood by one of ordinary skill in the art to which this disclosure belongs.

The terms and words used in the following description and claims are not limited to the bibliographical meanings, but, are merely used by the inventor to enable a clear and consistent understanding of the disclosure.

Terms like 'first', 'second', etc., may be used to indicate various components, but the components should not be restricted by the terms. These terms are only used to distinguish one element, component, region, layer or section from another region, layer or section.

As used herein, the singular forms "a", "an" and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

If the term "in front of", "behind", "above", "below", "left" or "right" is used, it refers not only to an occasion when a component is located "in front of", "behind", "above", "below", "to the left of" or "to the right of" another component, but also to an occasion when a component is located "in front of", "behind", "above", "below", "to the left of" or "to the right of" another component with a third component lying between the components.

Furthermore, if the terms "front", "back" are used, the "front" refers to the front side where doors of a refrigerator are arranged and the "back" refers to the opposite side of the front side, i.e., the rear side of the refrigerator.

If the terms "above", and "below" or "under" are used, the "up" refers to above and "down" refers to below a refrigerator shown in FIG. 1.

An ice maker in accordance with various embodiments of the present disclosure may be applied not only to refrigerators but also to other various devices for forming ice. In the following description, however, assume an ice maker arranged in a refrigerator for convenience of explanation.

Reference will now be made in detail to embodiments, examples of which are illustrated in the accompanying drawings, wherein like reference numerals refer to the like elements throughout.

Figure 2:
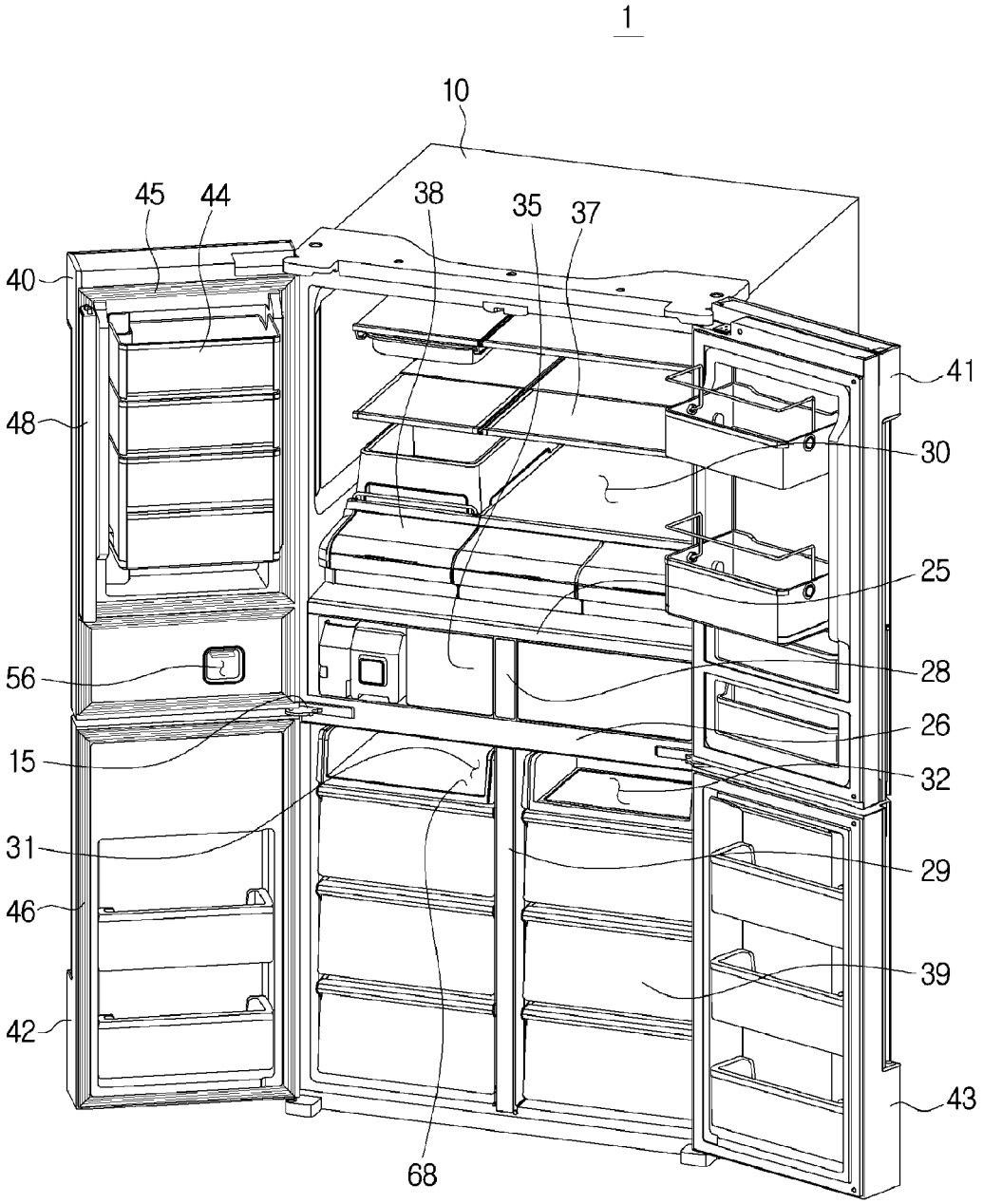
FIG. 2 illustrates a view showing an opening state of the refrigerator of FIG. 2 according to various embodiments of the present disclosure.
Figure 3:
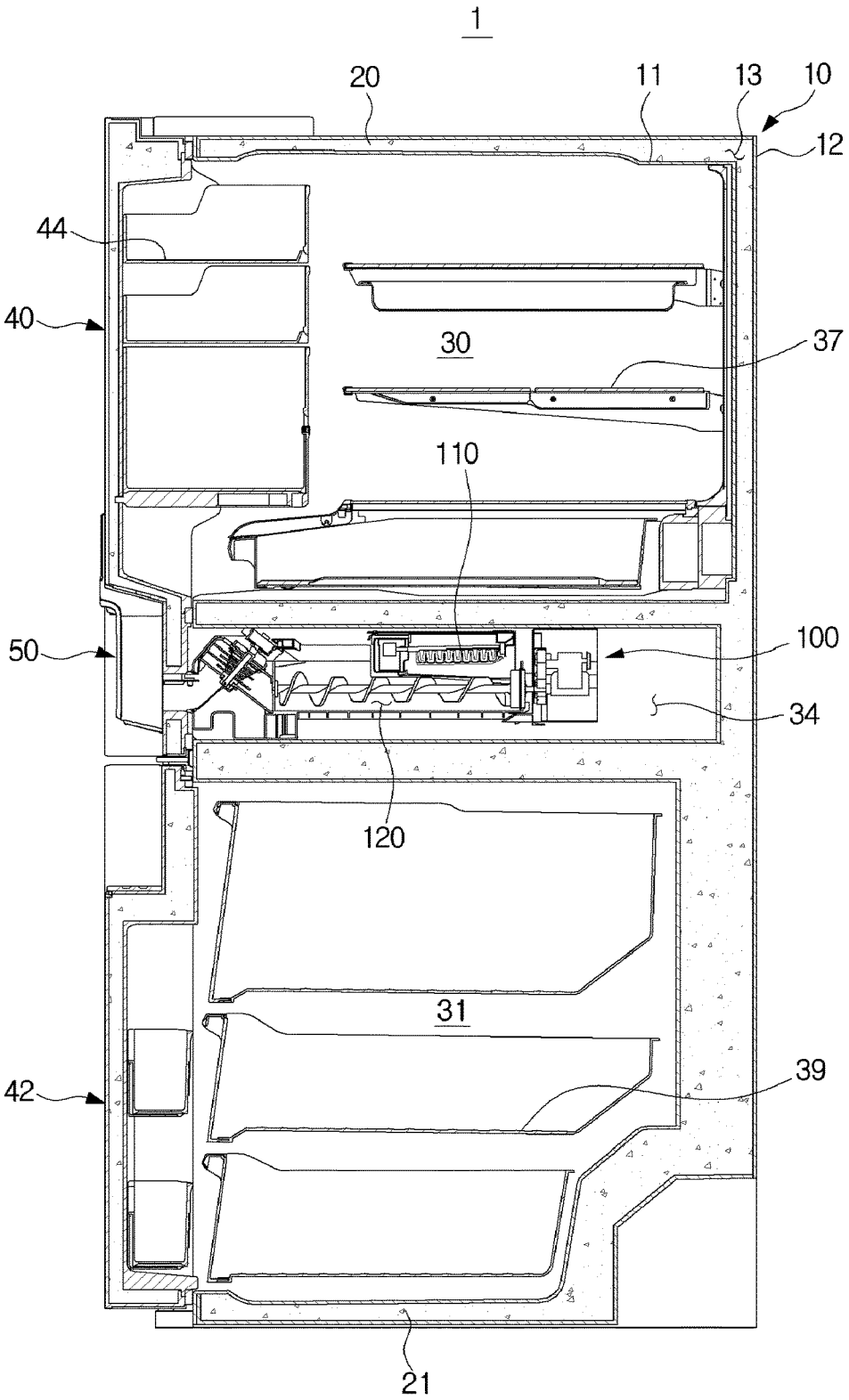
FIG. 3 illustrates a schematic side cross-sectional view showing a refrigerator according to various embodiments of the present disclosure.

FIG. 1 illustrates a front view of a refrigerator according to various embodiments of the present disclosure, FIG. 2 illustrates a perspective view of the refrigerator of FIG. 1 with the doors open; and FIG. 3 illustrates a schematic side cross-sectional view of the refrigerator of FIG. 1.

The refrigerator 1 may include a main body 10, storerooms 30, 31, 32, 33, 34, 35, 36 formed inside the main body 10, a cold air supply system (not shown) for supplying cold air to the storerooms 30, 31, 32, 33, 34, 35, 36, and doors 40, 41, 42, 43 for opening or closing the storerooms 30, 31, 32, 33, 34, 35, 36.

The storerooms 30, 31, 32, 33, 34, 35, 36 may include a top room 30, bottom rooms 31, 32, and a middle room 33 formed between the top room and bottom rooms 31, 32.

The top room 30 may be a fridge room 30 for keeping things cool. The fridge room 30 may be maintained at temperatures of about zero to five degrees Celsius to keep things cool.

The bottom rooms 31, 32 may have a first freezer room 31 for keeping things cold and a first temperature-changing room 32 having adjustable temperatures. The first freezer room 31 may be maintained at temperatures of about zero to minus thirty degrees Celsius to keep things frozen.

The first temperature-changing room 32 may have temperatures adjusted between temperatures for cooling and temperatures for freezing. The refrigerator 1 may include a temperature setting unit (not shown) for setting the temperature of the first temperature-changing room 32, a cold air adjuster (not shown) for adjusting an amount of cold air to be supplied to the first temperature-changing room 32, and a temperature controller (not shown) for controlling the cold air adjuster based on the temperature set by the temperature setting unit.

The temperature setting unit may be configured for the user to select one of a predetermined number of temperature ranges. For example, the temperature setting unit may have four temperature ranges: a freezing temperature range of about twenty three degrees to seventeen degrees below zero, a thin ice temperature range of about five degrees below zero, a special temperature range of about one degree below zero, and a fridge temperature range of about two degrees above zero, one of which is to be selected by the user. The temperature setting unit may have four buttons indicating the four temperature ranges. When the user presses one of the four buttons, the temperature controller may control the cold air adjuster to adjust the temperature of the first temperature-changing room 32.

The cold air adjuster may include a damping device for controlling an amount of cold air to be supplied to the first temperature-changing room 32.

However, unlike this embodiment of the present disclosure, a freezer room may replace the first temperature-changing room 32. That is, the entire bottom room may include all the freezer rooms.

The middle room 33 may include an ice maker room 34, a second freezer room 35, and a second temperature-changing room 36. The ice maker room 34, the second freezer room 35, and the second temperature-changing room 36 may be arranged in parallel in the left-and-right direction.

In certain embodiments, the ice maker room 34 and the second temperature-changing room 36 are partitioned by a middle wall 27 from each other. However, in other embodiments, the first middle wall 27 is omitted, and the ice maker room 34 and the second temperature-changing room 36 may not be partitioned off from each other.

An ice maker 100 may be arranged inside the ice maker room 34. The ice maker room 34 may be maintained at temperatures below zero to form and keep ice. Similar to the first freezer room 31, the second freezer room 35 may be maintained at temperatures of about zero to thirty degree Celsius below zero to keep things frozen.

The second freezer room 35 may be relatively small compared to the first freezer room 31, and thus, be called an auxiliary freezer room. In certain embodiments, the first freezer room 31 may be opened or closed by a bottom door 42, and the second freezer room 35 may be opened or closed by a top door 41. Accordingly, things relatively large and less frequently used may be kept in the first freezer room 31 while things relatively small and more frequently used may be kept in the second freezer room 35, to increase efficiency in storage maintenance and minimize unnecessary leakage of cold air.

Similar to the first temperature-changing room 32, the second temperature-changing room 36 may have temperatures adjusted between temperatures for cooling and temperatures for freezing.

However, in other embodiments of the present disclosure, a freezer room may replace the second temperature-changing room 36. That is, the middle room 33 may be comprised of the ice maker room 34 and a freezer room.

The main body 10 is shaped almost like a box with a front open. The main body 10 may include an inner case 11, an outer case 12 combined on the outer side of the inner case 11, and an insulation 13 arranged between the inner case 11 and the outer case 12.

The inner case 11 may be formed of a resin material through injection molding. There may be the fridge room 30, the first freezer room 31, the first temperature-changing room 32, and the ice maker room 34, the second freezer room 35, and the second temperature-changing room 36 formed inside the inner case 11. That is, the inner case 11 may define the respective storerooms.

The insulation 13 may be arranged between the inner case 11 and the outer case 12. The insulation 13 may use urethane foam insulation, and use a vacuum insulation panel along with the urethane foam insulation if necessary. The urethane foam insulation may be formed by having urethane foam with urethane and a foaming agent combined, filled and foamed between the inner case 11 and the outer case 12 after the inner case and the outer case 12 are combined. The urethane foam may have a high adhesive property to reinforce coupling performance between the inner case 11 and the outer case 12, which has enough strength once the foaming is complete.

By having the urethane foam filled and foamed between the inner case 11 and the outer case 12, a top wall 20, a bottom wall 21, left and right side walls (not shown), a back wall 24, a first partition wall 25, a second partition wall 26, and a middle wall 27 may be integrally formed together.

The first partition wall 25 partitions the internal space of the main body 10 into upper and lower spaces. Specifically, the first partition wall 25 partitions the fridge room 30 from the middle room 33. The second partition wall 26 partitions the internal space of the main body 10 into upper and lower spaces. Specifically, the second partition wall 26 partitions the middle room 33. The middle wall 27 divides the middle room 33 into left and right spaces, and divides the bottom room 31, 32 into left and right spaces.

Shelves 37 on which things are put, air-tight containers 38 for air-tightly containing things, and drawers 39 formed to slide forward or backward may be arranged in the respective storerooms.

Doors 40, 41, 42, 43 to open or close the storerooms 30 to 36 may include four doors: a first top door 40, a second top door 41, a first bottom door 42, and a second bottom door 43. The doors 40 to 43 may pivotally combined with the main body 10.

The first and second top doors 40 and 41 may be pivotally combined with the main body 10 by top and middle hinges 15, respectively. The middle hinge 15 may be combined with the second partition wall 26 to support the first and second top doors 40 and 41. The first and second top doors 40 and 41 may be pivotally opened or closed in the opposite directions. Respective handles 40*a*, 41*a* may be arranged in the inner sides of the first and second top doors 40 and 41.

The first and second top doors 40 and 41 may open or close the fridge room 31 and the middle room 33 together. Specifically, the first top door 40 may open or close a portion of the fridge room 31, the ice maker room 34, and the second freezer room 35, and the second top door 41 may open or close the other portion of the fridge room 31 and the second temperature-changing room 36.

Accordingly, when the first top door 40 is opened, one may access the fridge room 31 and the second freezer room 35 at the same time. When the second top door 41 is opened, one may access the fridge room 31 and the second temperature-changing room 36 at the same time.

There may be a filler 48 arranged on the first top door 40 for preventing cold air leakage between the first top door 40 and the second top door 41 while the first and second top doors 40 and 41 are closed.

There may be sealing members 45 arranged on the rear side of the top doors 40, 41 for preventing cold air leakage between the top doors 40, 41 and the main body 10 while the top doors 40, 41 are closed. The sealing member 45 may be formed of a rubber material.

The first and second bottom doors 42 and 43 may be pivotally combined with the main body 10 by middle hinges 15 and bottom hinges, respectively. The first and second bottom doors 42 and 43 may be pivotally opened or closed in the opposite directions. Respective handles 42*a*, 43*a* may be arranged in the inner sides of the first and second bottom doors 42 and 43.

The first bottom door 42 may open or close the first freezer room 31. The second bottom door 43 may open or close the first temperature-changing room 32.

The refrigerator 1 may include a dispenser 50 for providing water stored in the fridge room 30 or ice stored in an ice bucket 81 of the ice maker room 34. The user may take water or ice out through the dispenser 50 without opening the top door 40.

The dispenser 50 may include a discharger 51 having a water discharger 51*a* for discharging water and an ice discharger 51*b* for discharging ice, a dispensing space 53 for receiving a container to receive water or ice, a container supporter 54 for supporting the container to receive water or ice, a takeout hole 56 formed on the rear side of the door 40 for taking ice released from an outlet 412 of the ice maker 100 and delivered to the dispenser 50, which will be described below, a chute 52 for guiding the ice delivered to the takeout hole 56 to the ice discharger 51*b*, and an operation panel 55 for receiving commands of operation of the dispenser 50 and displaying the operation state.

The discharger 51 may be arranged on the top door 40. The ice discharger 51*b* may be formed at almost the same or higher level than the bottom floor of the ice bucket 81. This may shorten the length of the chute 52 as compared to that of the conventional refrigerator, and may increase grocery storage space on the rear side of the door 40.

The dispensing space 53 may be formed across a part of the top door 40 and a part of the bottom door 42. Specifically, the dispensing space 53 may include a first dispensing space 53*a* formed to be sunken from the front lower part of the top door 40, and a second dispensing space 53*b* formed to be sunken from the front upper part of the bottom door 42.

The container supporter 54 for supporting the container may be arranged below the second dispensing space 53*b*. That is, the container supporter 54 may be arranged in the bottom door 42.

This structure may allow the user to take out water or ice in more convenient positions and expand the available container size.

The ice maker 100 is placed in the ice maker room 34 for forming ice. There may be an ice making unit 110 for forming ice and the ice bucket 120 for keeping the ice formed by the ice making unit 110 arranged in the ice maker 110. The ice making unit 110 may include an ice maker tray for receiving water and an ejector for detaching the ice from the ice maker tray.

The ice making unit 110 may form ice in an indirect freezing method to freeze water by cold air in the ice maker room 34, or in a direct freezing method to freeze water with freezing energy received from direct contact between the ice maker tray and a refrigerant tube. The ice maker 100 will now be described in detail.

The cold air supply system may produce cold air using a refrigeration cycle. The cold air supply system may include a compressor (not shown), a condenser (not shown), an expansion valve (not shown), an evaporator (not shown), a blower fan (not shown), and at least one refrigerant circuit in which a refrigerant is circulated.

There are no limitations on the number and form of the compressor, condenser, expansion valve, evaporator, blower fan, and refrigerant circuit.

For example, the cold air supply system may include a plurality of refrigerant circuits: a first refrigerant circuit and a second refrigerant circuit. In the first refrigerant circuit, a first compressor, a first evaporator, and a first blower fan may be arranged. In the second refrigerant circuit, a second compressor, a second evaporator, a third evaporator, a second blower fan, and a third blower fan may be arranged.

The first blower fan may supply cold air generated from the first evaporator into the fridge room 30. The second blower fan may supply cold air generated from the second evaporator into the first freezer room 31, ice maker room 34, and second freezer room 35. The third blower fan may supply cold air generated from the third evaporator into the first temperature-changing room 32 and second temperature-changing room 36.

In other words, the cold air supply system may supply cold air to the three parts independently to cool the fridge room 30, which is a top room, the first freezer room 31, the ice maker room 34, and the second freezer room 35, which are middle and bottom left storerooms, and the first and second temperature-changing rooms 32 and 36, which are middle and bottom right storerooms, separately.

As described above, however, the cold air supply system is only by way of example, and the idea of the present disclosure is not limited to the cold air supply system for supplying cold air to the respective storerooms.

Furthermore, unlike the embodiment of the present disclosure, the refrigerator 1 may divide the storerooms 30 into top and bottom rooms 31 and 32 without including the middle room 33, in which case the ice maker 100 may be arranged in the bottom room 32 to keep the space in a frozen state. When the ice maker 100 is arranged in the bottom room 32, the ice maker 100 may be pushed in or pulled out by the bottom door 42, 43. The ice discharger 51*b* of the dispenser 50 may also be arranged on a side of the bottom door 42, 43 to correspond to the ice maker 100.

The ice maker 100 will now be described in detail.

Figure 4:
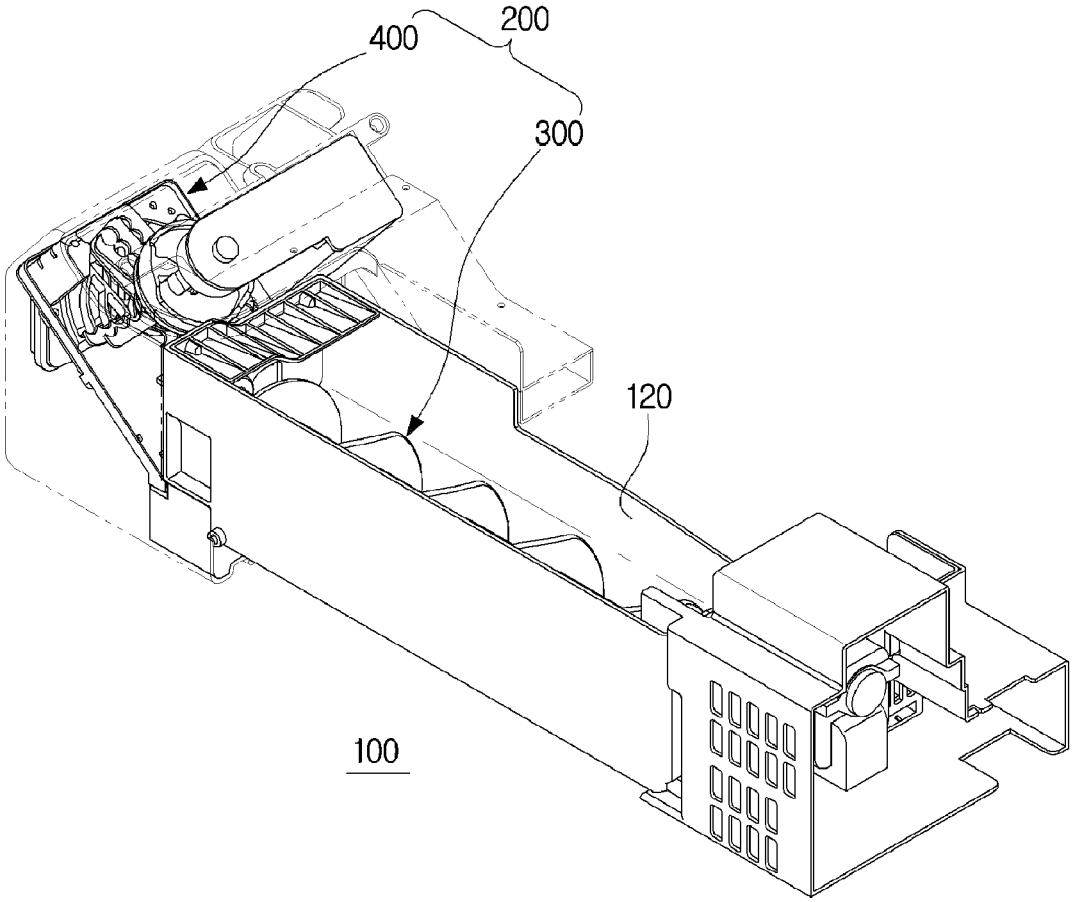
FIG. 4 illustrates a perspective view showing an ice maker according to various embodiments of the present disclosure.
Figure 5:
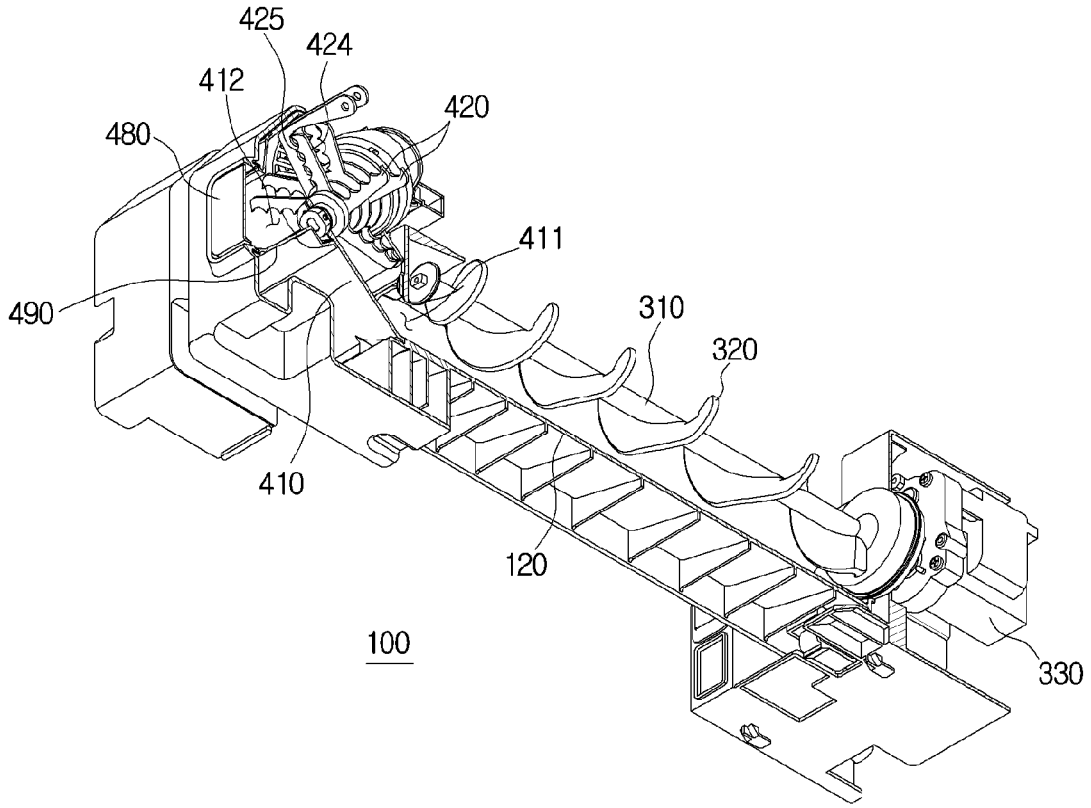
FIG. 5 illustrates a schematic perspective view of an ice making unit of FIG. 4 cut along a side of the ice making unit according to various embodiments of the present disclosure.
Figure 6:
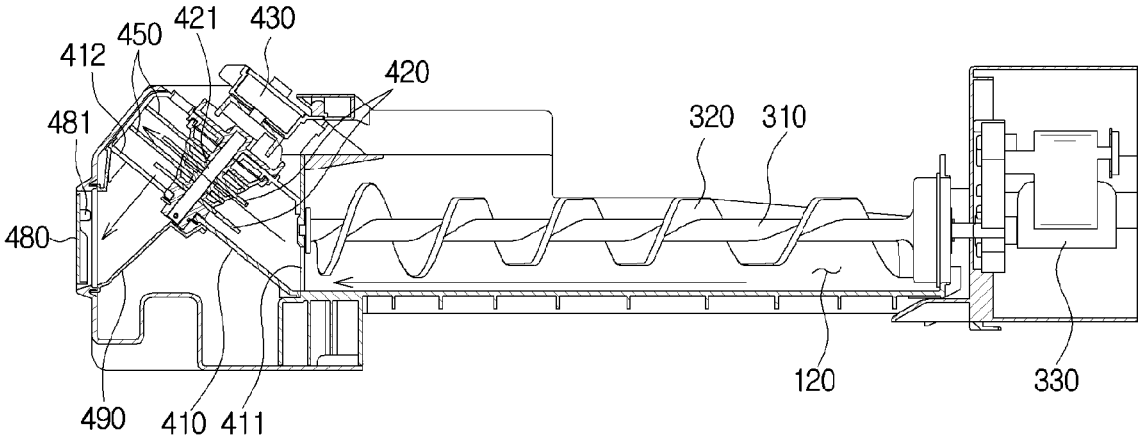
FIG. 6 illustrates a side cross-sectional view of the ice maker of FIG. 4 according to various embodiments of the present disclosure.
Figure 7:
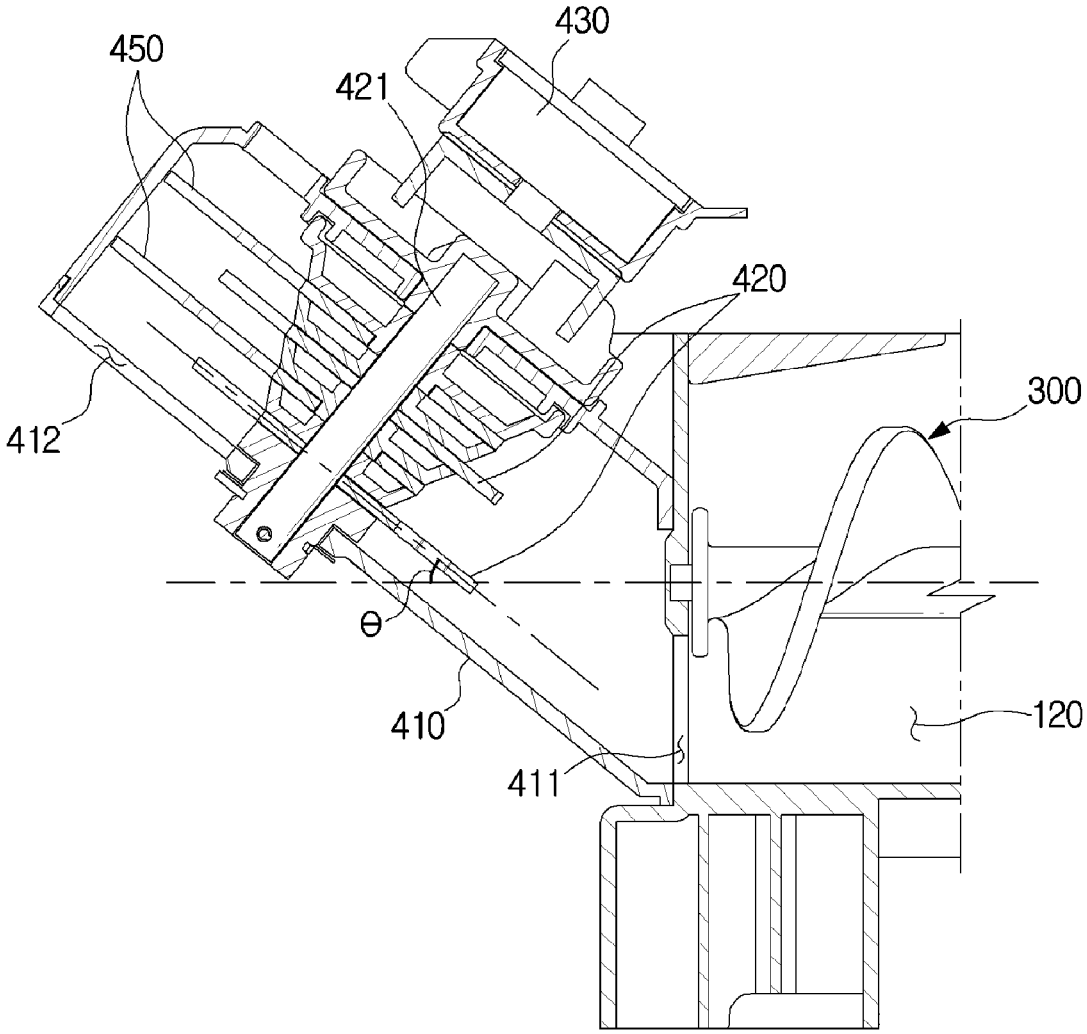
FIG. 7 illustrates an enlarged view of some parts of FIG. 6 according to various embodiments of the present disclosure.

FIG. 4 illustrates a perspective view of an ice maker of a refrigerator according to various embodiments of the present disclosure, FIG. 5 illustrates a schematic perspective view of an ice making unit of FIG. 4 cut along a side of the ice making unit, FIG. 6 illustrates a side cross-sectional view of the ice maker of FIG. 4, and FIG. 7 illustrates an enlarged view of some parts of FIG. 6.

As described above, the ice maker 100 may include the ice making unit 110 for forming ice, the ice bucket 120 for storing the ice formed by the ice making unit 110, and a transporter 200 for transporting the ice stored in the ice bucket 120 to the dispenser 50.

The ice bucket 120 may be arranged below the ice making unit 110 for storing ice detached by the ejector from the ice maker tray. Accordingly, the ice bucket 120 may be shaped almost like a box with the top open. There may be a full-ice detector (not shown) in the ice bucket 120 for detecting whether the ice is formed in the ice bucket 120 to the full extent.

The ice bucket 120 may be formed by extending from the front to the back of the ice maker room 34. The longer the ice bucket 120 extends in the front-to-back direction, the more ice the ice bucket 120 may be able to store. Accordingly, the ice bucket 120 may extend across a part of the front-to-back direction of the ice maker room 34 as shown in FIG. 3, without being limited thereto. For example, the ice bucket 120 may extend across a length corresponding to the front-to-back direction of the ice maker room 34.

The transporter 200 may include an auger 300 arranged inside the ice bucket 120 for moving the ice stored in the ice bucket 120 to the outside of the ice bucket 120, and a blade unit 400 for moving the ice transported by the auger 300 upward.

The auger 300 may include an auger shaft 310 extending in parallel with the ice bucket 120 in the front-to-back direction, a spiral wing 320 spirally protruding in the radial direction from the auger shaft 310, and a first driving motor 330 for providing turning force to the auger shaft 310.

When the first driving motor 330 is driven, the auger shaft 310 and spiral wing 320 are rotated and the spiral wing 320 may transport the ice along the direction of the auger shaft 310. In other words, the auger 300 may be rotated to transport the ice stored in the ice bucket 120 to the front of the ice bucket 120.

The ice transported by the auger 300 to the front of the ice bucket 120 may be moved out of the ice bucket 120 through an opening formed on the front side of the ice bucket 120.

The opening formed on the front side of the ice bucket 120 may be linked to an inlet 411 formed in a case 410 of the blade unit 400. In an embodiment of the present disclosure, as the front side of the ice bucket 120 and a side of the case 410 are configured to come into contact, the opening formed on the front side of the ice bucket 120 and the inlet 411 of the case 410 may be formed in the same configuration.

Specifically, the inlet 411 may be a space to which the ice transported by the auger 300 from the ice bucket 120 to the opening linked to the ice bucket 120 comes to the inner side of the blade unit 400.

It is not, however, limited thereto, but the ice bucket 120 and the case 410 may be separately arranged, in which case the opening formed on the front side of the ice bucket 120 and the inlet 411 may be separately configured and an extra path to link the opening and the inlet 411 may further be arranged.

The blade unit 400 may be arranged between the dispenser 50 and the ice bucket 120 for moving the ice transported from the ice bucket 120 upward to the dispenser 50.

The blade unit 400 may include a case 410, a blade 420 arranged inside the case 410 for moving the ice upward and crushing some of the ice, and a second driving motor 430 for delivering turning force to the blade 420.

As described above, the case 410 may come into contact with the front side of the ice bucket 120 on a side to link the inside of the case 410 to the inside of the ice bucket 120.

The case 410 may be shaped like a rectangular box, and may be arranged at an angle from the vertical direction of the ice bucket 120. In other words, the case 410 may be arranged to slantingly extend upward from the front side of the ice bucket 120.

Accordingly, the bottom part of the case 410 may come into contact with the ice bucket 120, and the top part of the case 410 may be separated from the ice bucket 120. In other words, the case 410 may be slantingly arranged from the vertical direction with the bottom part of the case 410 arranged to be adjacent to the ice bucket 120 and the top part of the case 410 arranged to be adjacent to the dispenser 50.

As described above, the case 410 may include the inlet 411 arranged in the bottom part and an outlet 412 arranged in the top part for discharging the ice delivered to the inlet 411 and moved upward to the dispenser 50.

Accordingly, the ice may be moved upward through the inlet 411 and discharged out of the blade unit 400 through the outlet 412, and there may be a slider 490, a space arranged between the outlet 412 and the takeout hole 56, into which the ice is moved to be transported to the takeout hole 56 of the dispenser 50.

The slider 490 may be slantingly arranged down from the outlet 412 to the takeout hole 56 for the ice released from the outlet 412 to slide to the takeout hole 56.

A blade 420 may be arranged inside the case 410 to move the ice upward by being rotated. The blade 420 may extend from a blade shaft 421 rotated by turning force delivered from the second driving motor 430 to the outside of a radius of the blade shaft 421.

There may be one or more blades 420, rotating around the blade shaft 421 to move the ice to the direction in which the blade 420 rotates.

The blade 420 may make a turn by rotating clockwise or counterclockwise upward from the inlet 411 to the outlet 412 and then downward past the outlet 412 to the inlet 411.

In other words, the blade 420 may involve making both upward and downward turns while making a turn, and in an embodiment of the present disclosure, a direction in which the blade 420 rotates refers to not only the upward turn direction, in which the blade 420 rotates from the inlet 411 to the outlet 412.

The blade shaft 421 may be arranged such that the blade 420 may be rotated upward. Specifically, the blade 420 needs to be slantingly rotated forward and upward to move the ice to the takeout hole 56 formed in upper front of the ice bucket 120. Accordingly, in order for the blade 420 to be rotated forward and upward while the blade 420 is slantingly arranged, the blade shaft 421 may be arranged to slantingly extend in the forward and downward direction, which is perpendicular to the blade 420 (see FIG. 7).

As described above, as the blade shaft 421 is slantingly arranged in the forward and downward direction, the blade 420 may be rotated while slantingly arranged in the forward and upward direction, perpendicular to the blade shaft 421. Accordingly, the blade 420 may be rotated along with ice in the forward and upward direction to move the ice upward to the dispenser 50.

Specifically, settlers 424, 425 may be arranged on either side of the blade 420 in the direction of the length of the blade 420 to settle ice, and the ice settled in the settlers 424, 425 may be rotated around the blade shaft 421 along with the blade 420.

The ice transported to the inlet 411 formed on the bottom of the case 410 may be temporarily settled in the settlers 424, 425 while coming into contact with the blade 420, and transported to the top of the case 410 while being rotated.

While the blade 420 is rotating upward from the inlet 411, the blade 420 is positioned below the ice and the ice is naturally settled in the blade 420 and rotated upward along with the blade 420.

However, if the blade 420 is rotated upward and reaches the outlet 412, positions of the ice and blade 420 may be reversed due to the rotation of the blade 420 and the ice may fall away from the blade 420 and then fall. The ice may fall out of the case 410 through the outlet 412 formed on the top of the case 410.

In other words, the blade 420 may transport the ice along the direction in which the blade 420 rotates, and while the blade 420 is rotating upward, the ice may be temporarily settled in the settler 424, 425 of the blade 420 and rotated upward along with the blade 420.

After this, if the blade 420 reaches the outlet 412 formed on the top, the ice may fall away from the settler 424, 425 and fall down, and at this time, the ice may be released out of the blade unit 400 through the outlet 412.

Specifically, the transporter 200 may primarily move the ice stored in the ice bucket 120 in the horizontal direction by the auger 300 and secondarily move the ice upward by the blade unit 400.

In the secondary process of moving the ice, a height that the ice may be moved upward may be determined depending on the angle at which the blade 420 is slanted to the auger 300. Depending on the angle at which the blade 420 is slanted, i.e., angle θ formed between the direction in which the blade 420 rotates and the auger shaft 310 or the bottom side of the ice bucket 120, the height that the ice is lifted to may vary.

If the angle θ formed by the rotation direction of the blade 420 and the auger shaft 310 is large, the ice could be moved higher as the rotation direction of the blade 420 is directed further upward.

Accordingly, the ice may be transported upward to various points by adjusting the angle θ formed by the rotation direction of the blade 420 and the auger shaft 310. The angle θ may preferably be about twenty to fifty degrees.

As described above, the larger the angle θ is the higher the ice may be transported, but as the angle θ is close to ninety degrees, the ice transported to a point close to the outlet 412 may not fall outside through the outlet 412 but fall back inside the case 410 and not be released out of the blade unit 400 as the blade 420 is rotated downward. To address the problem, the angle θ may be set between about twenty to fifty degrees to facilitate falling of the ice through the outlet 412 as the blade 420 rotates.

It is not, however, limited thereto, but the angle θ may be set differently depending on a difference between heights at which the ice bucket 120 and the dispenser 50 are arranged. If the difference between heights at which the ice bucket 120 and the dispenser 50 are arranged is large, the angle θ is to be set to a large angle to move the ice further upward, and otherwise if the difference between heights at which the ice bucket 120 and the dispenser 50 are arranged is small, the angle θ is to be set to a small angle to move the ice less upward.

As described above, the transport device 200 may be divided into the auger 300 that is regarded as a first transporter and the blade unit 400 that is regarded as a second transporter, which operate independently to move ice.

The auger 300 and the blade unit 400 may include their respective shafts 310 and 421, which may extend in opposite directions to each other. Specifically, the auger shaft 310 may extend in parallel with the ice bucket 120 in the front-to-back direction of the ice bucket 120, and the blade shaft 421 may be slanted down to the front in the vertical direction of the ice bucket 120.

The auger shaft 310 and the blade shaft 421 may be respectively driven by the first and second driving motors 330 and 430, which respectively deliver turning force to the auger shaft 310 and the blade shaft 421. Accordingly, the auger 300 and the blade unit 400 may be separately driven by different driving devices.

The auger 300 may transport ice to a direction perpendicular to the rotation direction of the auger shaft 310, while the blade unit 400 may transport ice to a direction in which the blade 420 rotates. In other words, the auger 300 may transport ice to a direction to which the auger shaft 310 extends, while the blade unit 400 may transport ice from the radial direction of the blade shaft 421 to a direction in which the blade 420 rotates.

In a case of a conventional transporter, in order to transport the ice upward by an auger, an auger shaft may extend upward to the front.

In this case, since the auger is arranged inside the ice bucket and extends along a single shaft in the front-to-back direction, the height that the ice may be transported upward may be limited depending on the ice maker room or the space of the ice bucket.

On the contrary, according to an embodiment of the present disclosure, the blade unit 400 added separately in addition to the auger 300 may allow the shafts 310, 421 to be easily arranged in a small space, so the problem of limiting the ice lift depending on the space will be solved.

The blade unit 400 will now be described in detail.

Figure 8:
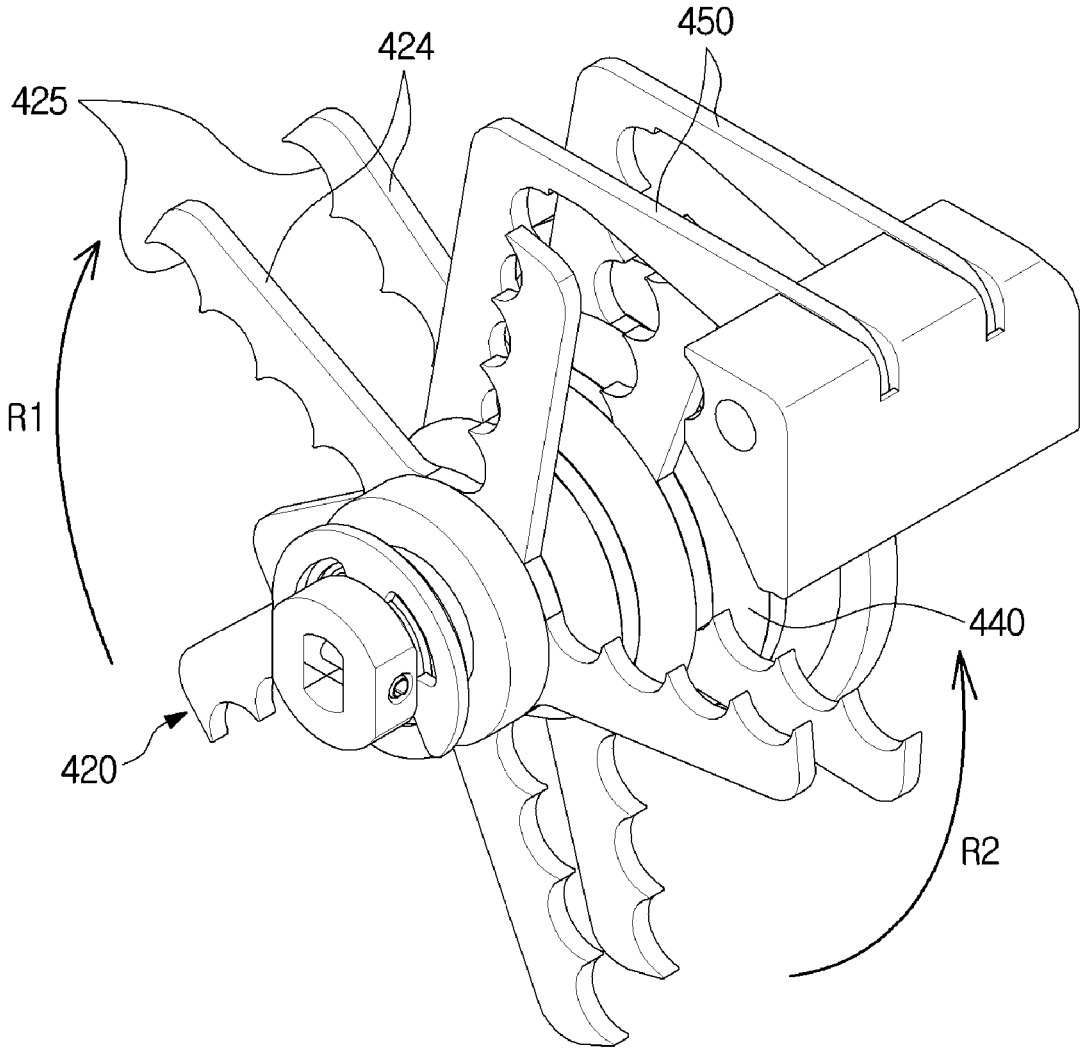
FIG. 8 illustrates a part of a blade unit of an ice maker of a refrigerator according to various embodiments of the present disclosure.
Figure 9:
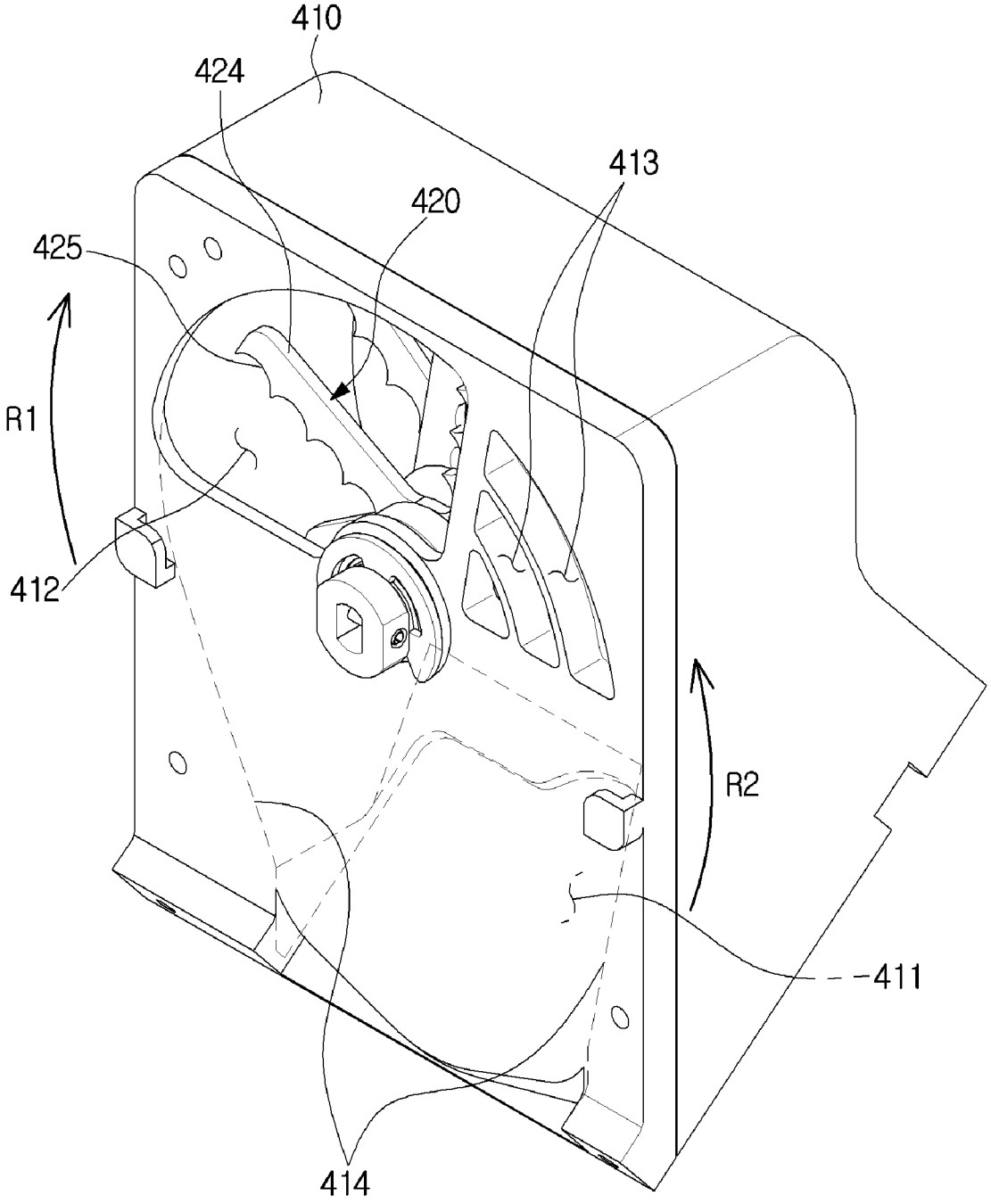
FIG. 9 illustrates a front view of the front side of a blade unit of an ice maker of a refrigerator according to various embodiments of the present disclosure.

FIG. 8 illustrates a part of a blade unit of an ice maker of a refrigerator according to various embodiments of the present disclosure, and FIG. 9 illustrates a front view of the front side of a blade unit of an ice maker of a refrigerator according to various embodiments of the present disclosure.

Referring to FIGS. 8 and 9, inside the case 410 of the blade unit 400, the blade 420, a hub 440 arranged on the blade shaft 421 in a tapered form slanted toward the outlet 412 (see also FIG. 7), and a fixed blade 450 for crushing the ice transported by the blade 420 may be included.

As described above, the blade 420 may not only transport the ice upward by being rotated, but also crush the ice by being rotated while crossing the fixed blade 450.

Specifically, when the blade 420 is rotated in a direction R1, ice may be settled in the first settler 424 arranged on a side of the blade 420, transported to the outlet 412 by being rotated along with the blade 420, and discharged out of the blade unit 400 through the outlet 412.

If the blade 420 is rotated in the other direction R2, ice may be settled in the second settler 425 arranged on the other side of the blade 420, rotated along with the blade 420, and crushed by the fixed blade 450 arranged in a rotation path of the other direction R2.

Some ice crushed by the fixed blade 450 that remains in the second settler 425 of the blade 420 may be rotated and discharged through the outlet 412.

There may be a plurality of blades 420, which may be arranged with a gap from one another in a direction in which the blade shaft 421 extends.

There may be one or more fixed blades 450. The at least one fixed blade 450 may be arranged between the plurality of blades 420. The plurality of blades 420 may be arranged with a gap from one another in a direction in which the blade shaft 421 extends. Accordingly, when the blade 420 makes a turn, the blade 420 may rotate without any restraints even if the blade 420 crosses the fixed blade 450.

The fixed blade 450 may be arranged in a rotation path in which fixed blade 450 is rotated upward from the inlet 411 to the outlet 412 while the blade 420 is rotating in the other direction R2. This is to discharge the ice through the outlet 412 after crushing the ice in the process of transporting the ice by the blade 420 rotating in the other direction R2.

The second driving motor 430 may switch the direction R1 of rotation of the blade 420 to the other direction R2 under the control of a controller (not shown).

If information to discharge non-crushed ice is input to the controller (not shown) of the dispenser 50, the second driving motor 430 may generate turning force to rotate the blade 420 in the one direction R1.

Accordingly, the ice moved to the inside of the case 410 through the inlet 411 may be settled and rotated in the first settler 424 in the one direction R1 as the blade 420 rotates, transported to the outlet 412, and discharged out of the blade unit 400 through the outlet 412.

If information to discharge crushed ice is input to the controller (not shown) of the dispenser 50, the second driving motor 430 may generate turning force to rotate the blade 420 in the other direction R2.

Accordingly, the ice moved to the inside of the case 410 through the inlet 411 may be settled and rotated in the second settler 425 in the other direction R2 as the blade 420 rotates, and transported to the outlet 412.

In the rotation path to the outlet 412, the fixed blade 450 is arranged to crush ice by colliding with the ice settled in the second settler 425, and the crushed ice may keep rotating along with the blade 420 and thus be transported to the outlet 412.

The second settler 425 may include pointed jags to crush the ice. Also, on a side of the fixed blade 450 facing the second settler 425, pointed jags may be included as well.

There may be an auxiliary outlet 413 formed on the upper part of the case 410 for preventing the ice being crushed from falling inside the case 410 without falling through the outlet 412.

Ice may be crushed while the blade 420 is crossing the fixed blade 450, and the crushed ice may remain in the second settler 425 and be transported to the outlet 412. In this case, some crushed ice may fall between the blades 420, or fall away from the second settler 425 and fall down the case 410 while being crushed.

If the ice fallen inside the case 410 is piled up, the case 410 may restrict a way of the ice coming into the inlet 411 and thus interfere with transportation of the ice, and the ice may remain inside the case 410 and thus cause sanitary issues.

To avoid this, the auxiliary outlet 413 may be formed between the inlet 411 and the outlet 413 in the rotation path of the blade 420 in the other direction R2. In other words, to prevent the ice transported along the other direction R2 from falling back down along the path in which the ice has been lifted, the auxiliary outlet 413 may be formed in the rotation path of the other direction R2.

Accordingly, while being crushed, some of the crushed ice that have not reached the outlet 412 may not fall down the case 410 but fall to the auxiliary outlet 413 and thus be released out of the blade unit 400.

In the lower part of the case 410, a lift guide 414 may be arranged for guiding the ice transported through the inlet 411 to be settled in the settlers 424, 425 to be moved upward.

The lift guide 414 may include a concave curved plane corresponding to the radius of rotation of the blade 420. The lift guide 414 may be located on either side of the lower part of the case 410 for guiding all the ice transported in both directions R1 and R2.

After moved to the inside of the case 410 through the inlet 411, the ice contacts the settlers 424, 425 of the rotating blade 420, and is settled in the settlers 424, 425 and then transported upward.

When the ice is settled in the settlers 424, 425, the ice contacts the settlers 424, 425 on a side at a location near the inlet 411, and is lifted with the blade 420 in contact with the ice as the blade 420 continues to rotate, and at this time, the ice may be rotated upward along with the blade 420 while the settlers 424, 425 support the bottom side of the ice.

If the other side of the ice is not supported at a location near the inlet 411, the ice is in contact with the settlers 424, 425 on a side and pressed by the blade 420, but may not fall away from the settlers 424, 425 while the blade 420 is rising, and thus, fail to rotate upward along with the blade 420.

To prevent this, while a side of the ice placed near the inlet 411 contacts the settlers 424, 425, the other side of the ice may be supported by the lift guide 414 and thus, the ice may be stably settled in the settlers 424, 425. The lift guide 414 may have the form of a curved plane to smoothly guide the ice to be transported upward.

The hub 440 of a tapered form slanted toward the outlet 412 may be arranged on the blade shaft 421. Specifically, the hub 440 may be in a tapered round form that has the radius reduced as the hub 440 gets closer to the outlet 412 along the blade shaft 421.

Accordingly, as shown in FIG. 7, the hub 440 may guide the ice transported to the outlet 412 to fall to the outlet 412 along the circumferential plane of a tapered form.

The circumferential plane of the hub 440 may include a guide plane for guiding the ice to be transported to the outlet 412 to prevent the ice transported upward from falling back inside the case 410 without falling to the outlet 412.

Specifically, if the ice is settled in the back of the blade 420 and transported upward, the ice may not be discharged out of the blade unit 400 through the outlet 412 formed on the front side, and thus transported back down the case 410 as the blade 420 rotates. In this case, even the ice settled in the back may be guided along the slope of the guide plane to the front side, and then discharged through the outlet 412.

A process of ice transportation to the dispenser 50 in the transporter 200 will now be described in detail.

Figure 10:
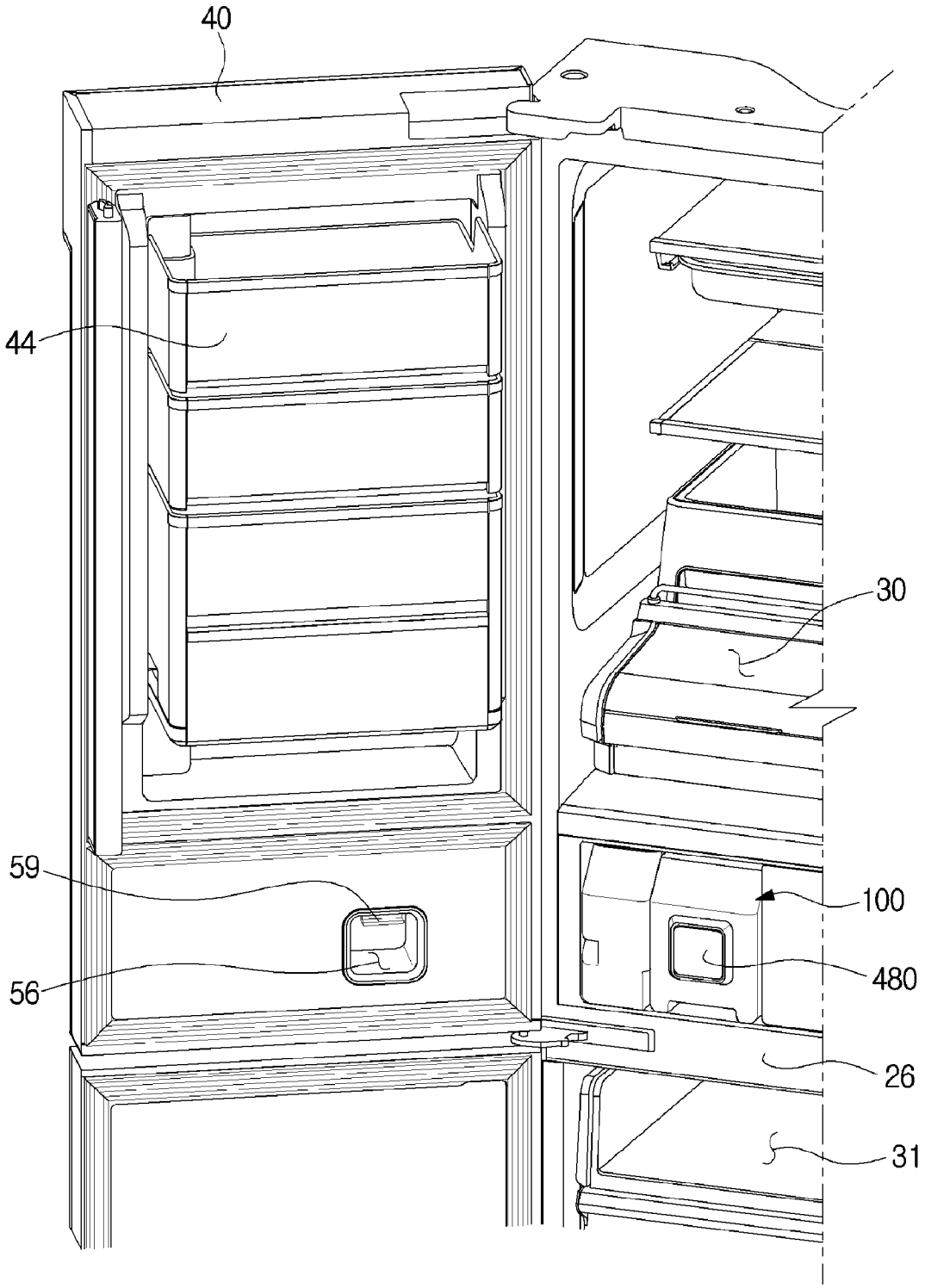
FIG. 10 illustrates an enlarged view of some parts of FIG. 2 according to various embodiments of the present disclosure.
Figure 11:
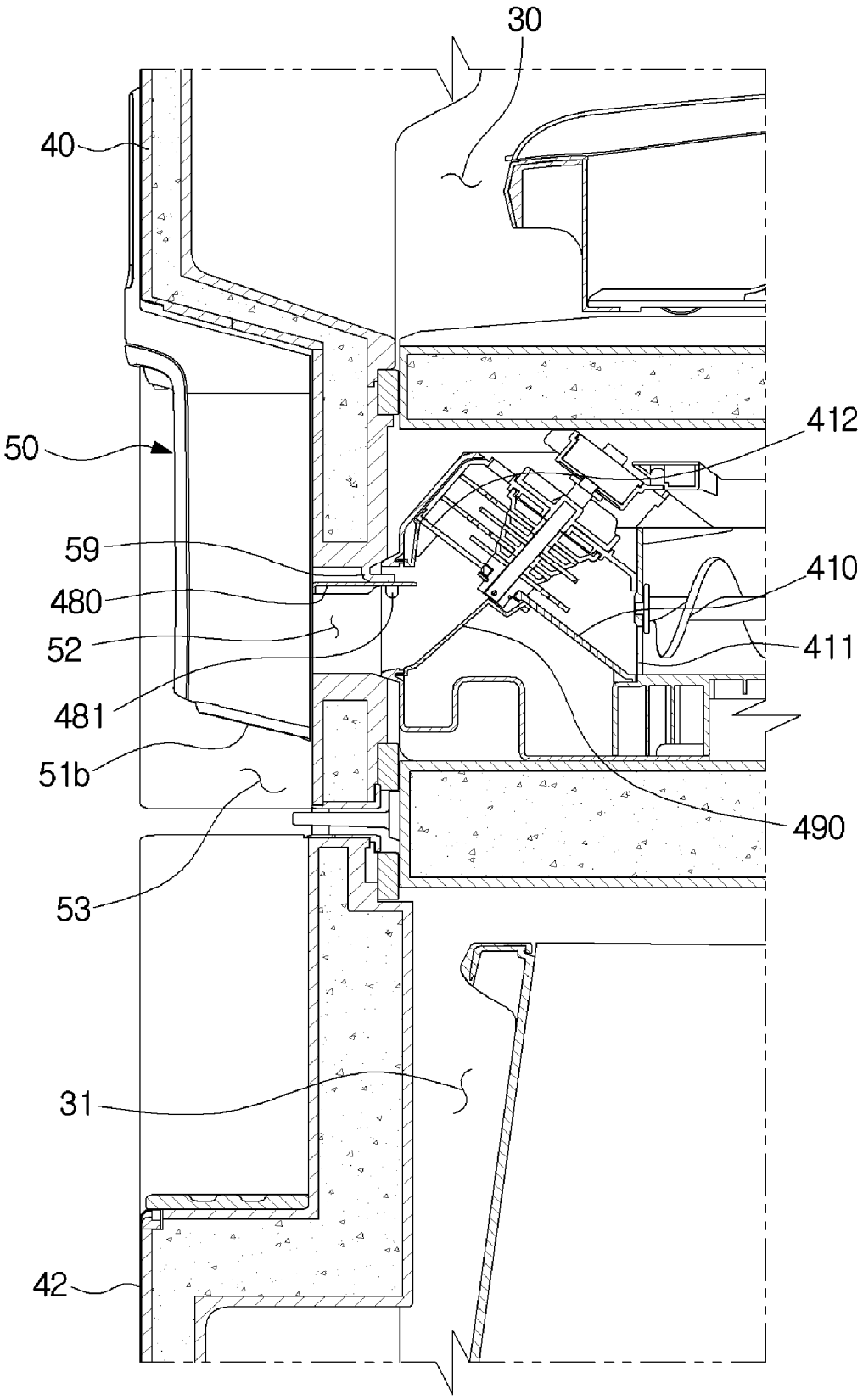
FIG. 11 illustrates an enlarged view of some parts of FIG. 3 according to various embodiments of the present disclosure.

FIG. 10 illustrates an enlarged view of some parts of FIG. 2, and FIG. 11 illustrates an enlarged view of some parts of FIG. 3.

Referring to FIGS. 10 and 11, on the rear side of the first top door 40, the takeout hole 56 linked to the ice discharger 51*b* of the dispenser 50 may be formed. The ice moved by the transporter 200 upward of the ice bucket 120 may be moved to the takeout hole 56 along the slider 490, and may pass the chute 52 and finally be discharged out of the refrigerator 1 through the ice discharger 51*b*.

At an opening of the slider 490, an opening/closing member 480 may be formed to close the slider 490 when the first top door 40 is opened and to open the slider 490 to be linked to the takeout hole 56 when the first top door 40 is closed.

The opening/closing member 480 may be pivotally arranged at the opening of the slider 490. A pivotal hinge 481 may be arranged in the upper part of the opening/closing member 480 to pivot the pivotal hinge 481 on the rotation axis.

An open/close projection 59 protruding toward the rear side of the first top door 40 may be arranged on the top side of the takeout hole 56 to press the open/close member 480 when the first top door 40 is closed.

The open/close projection 59 may be located higher than the pivotal hinge 481, and as shown in FIG. 11, may be opened as the open/close member 480 rotates by pressing a part higher than the pivotal hinge 481 of the open/close member 480 when the first top door 40 is closed.

There is a mounting recess formed to be sunken along the circumference of the opening of the takeout hole 56 and a protruding mounter formed along the opening of the slider 590 to correspond to the mounting recess, and accordingly, the opening of the slider 490 and the takeout hole 56 may be tightly shut when the first top door 40 is closed.

When the first top door 40 is opened, as the open/close projection 59 is detached from the open/close member 480, the open/close member 480 may turn around back to the original position, thereby closing the opening of the slider 490 to not expose the slider 490 to the outside air.

An ice maker 100*a* in accordance with another embodiment of the present disclosure will now be described. The same or similar features to those of the ice maker 100 in accordance with the previous embodiment of the present disclosure will not be described again.

Figure 12:
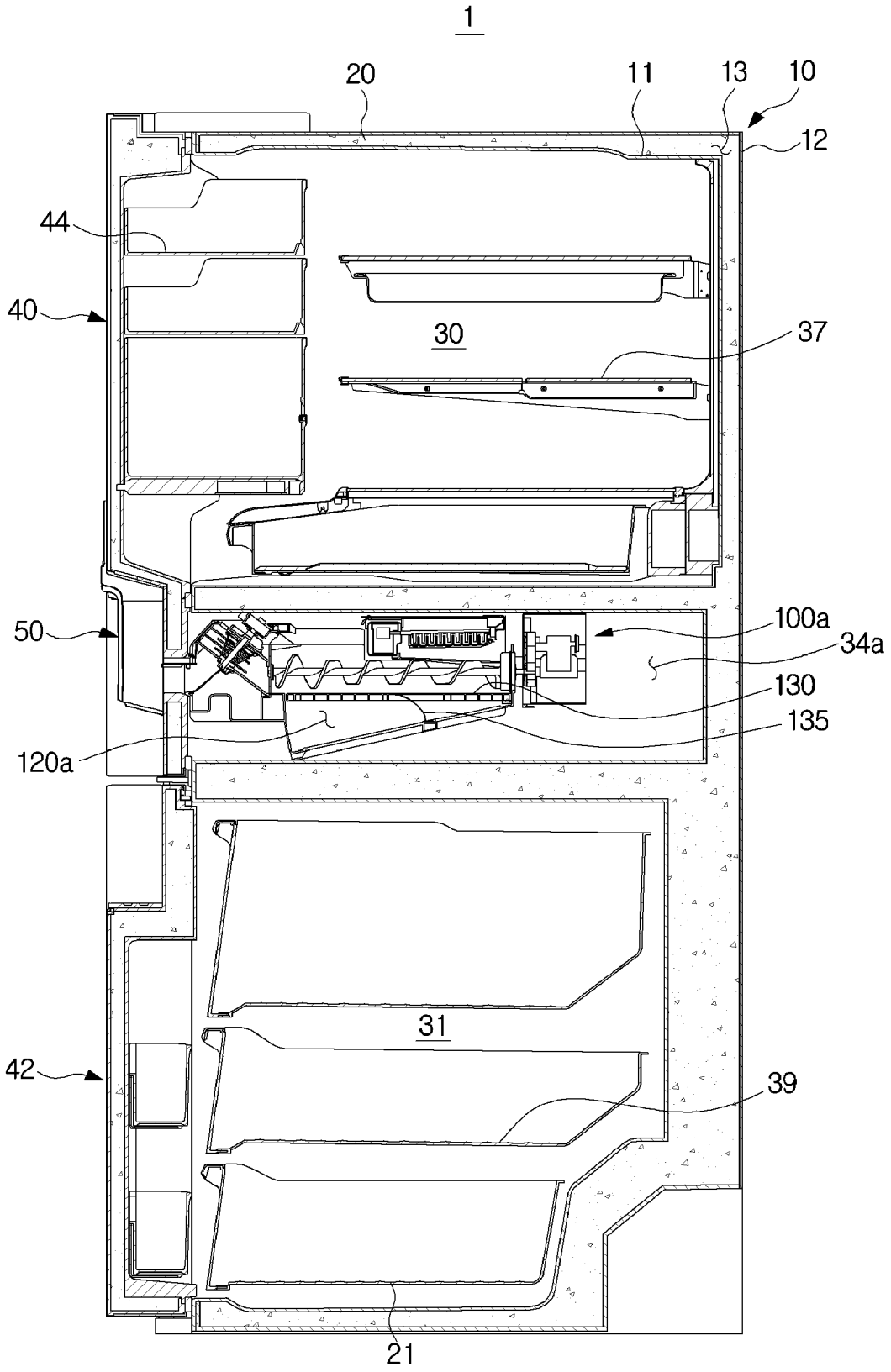
FIG. 12 illustrates a side cross-sectional view of a refrigerator according to various embodiments of the present disclosure.
Figure 13A:
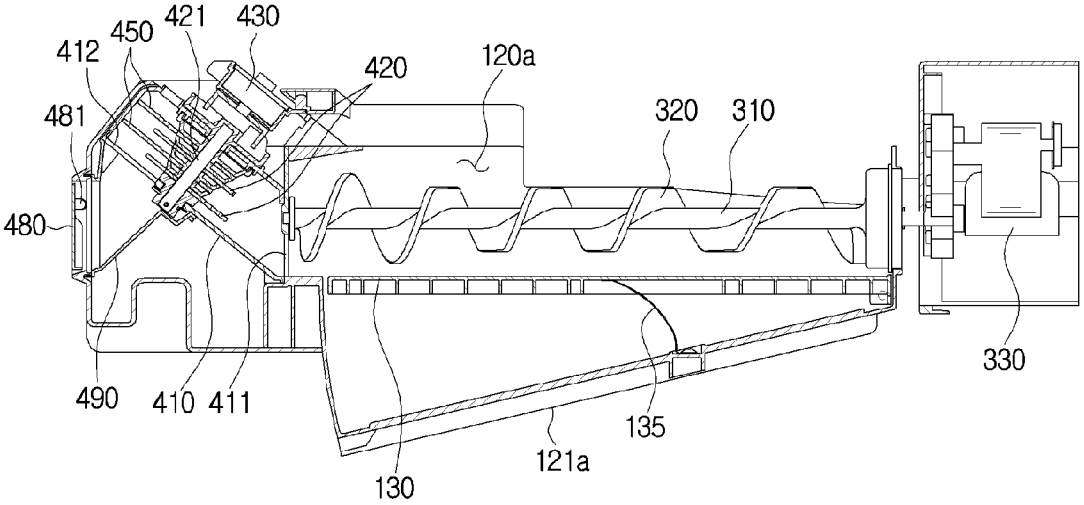
FIGS. 13A and 13B illustrate a side of an ice maker of a refrigerator according to various embodiments of the present disclosure.
Figure 13B:
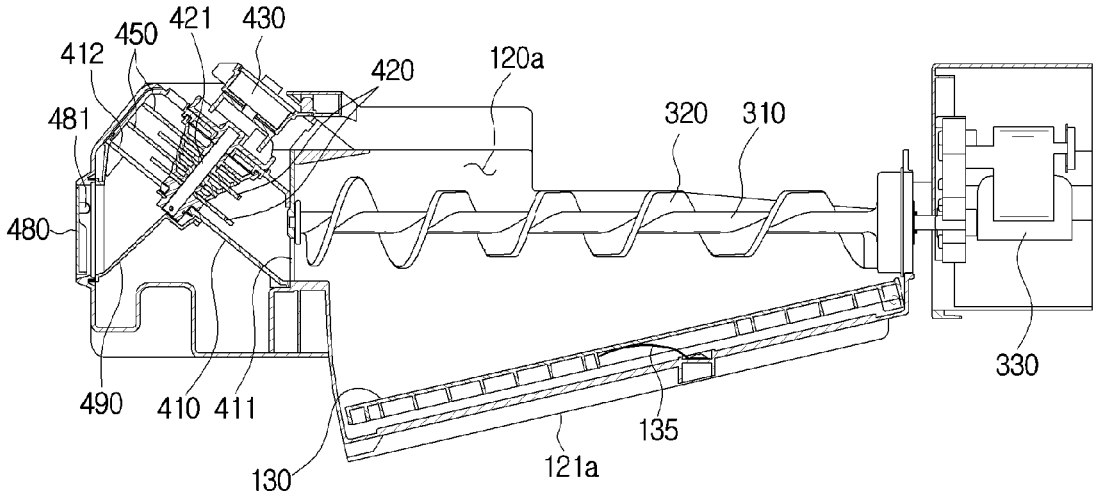
Figure 14:
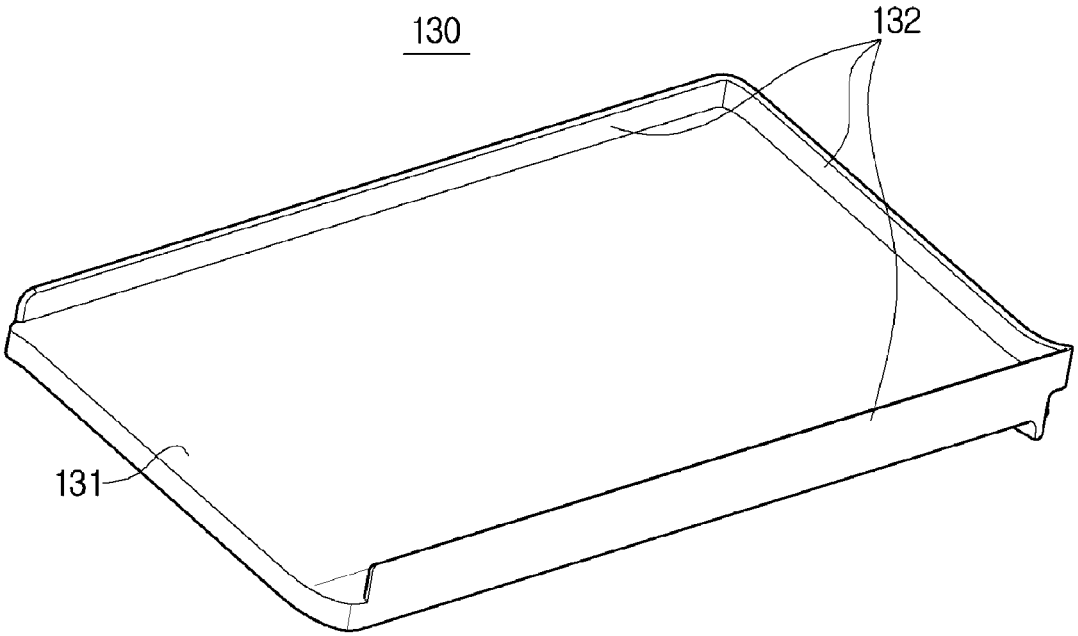
FIG. 14 illustrates a part of an ice maker of a refrigerator according to various embodiments of the present disclosure.
Figure 15:
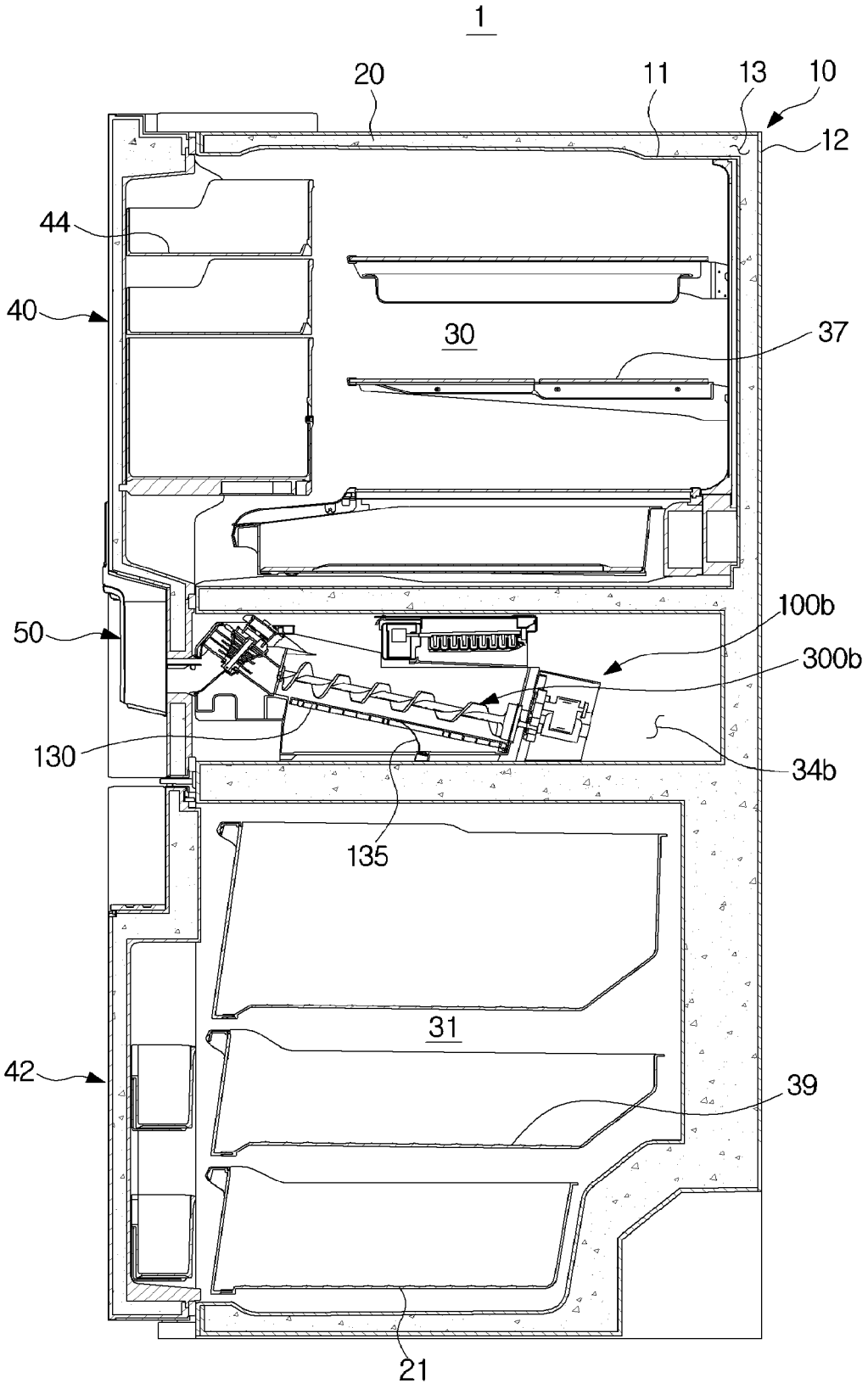
FIG. 15 illustrates a side cross-sectional view showing a refrigerator according to various embodiments of the present disclosure.

FIG. 12 illustrates a side cross-sectional view of a refrigerator according to another embodiment of the present disclosure, FIGS. 13A and 13B illustrate a side of an ice maker of a refrigerator according to another embodiment of the present disclosure, and FIG. 14 illustrates a part of an ice maker of a refrigerator, according to another embodiment of the present disclosure.

The refrigerator 1 may have a larger storage capacity as demanded by the user. A longer height of an ice maker room 34*a* than the height of the ice maker room 34 in accordance with the previous embodiment of the present disclosure may expand the storage capacity of the ice maker room 34*a* to store more amount of ice.

As the height of the ice maker room 34*a* increases, the vertical length of the ice bucket 120*a* may increase accordingly, in which case the ice stored on a bottom side 121*a* of an ice bucket 120*a* ends up being located outside of the rotation radius of the auger 300 and thus not being transported by the auger 300 to the front side of the ice bucket 120*a* and staying on the bottom side 121*a*.

To prevent this, there may be an ice lifter 130 on the bottom side 121*a* of the ice bucket 120*a* for lifting the ice stored in the ice bucket 120*a*.

The ice lifter 130 may include a lifting plate 131 for lifting ice, and an elastic member 135 for elastically supporting the lifting plate 131. The lifting plate 131 may be pivotally combined at a point of the ice bucket 120*a*.

Specifically, the bottom side 121*a* may be slanted down to the front side. As the bottom side 121*a* is slanted downward, the vertical length of the ice bucket 120*a* increases and accordingly, the storage capacity of the ice bucket 120*a* may increase.

It is not, however, limited thereto, but the bottom side 121*a* may be slanted down to the back side or to the left or right side. The ice bucket 120*a* may be arranged to correspond to a spatial structure of the ice maker room 34 formed by the shape of the inner case 11, and may have the bottom side 121*a* with a corresponding slope if the lower space of the ice maker room 34 has an inclination.

The lifting plate 131 may be pivotally combined on the top of the inclined bottom side 121*a*. Accordingly, the lifting plate 131 may be moved upward from the bottom side of the ice bucket 120*a* by pivoting on the top of the bottom side 121*a*.

The elastic member 135 may be arranged under the lifting plate 131 to elastically support the lifting plate in the vertical direction. As shown in FIG. 13A, if a small amount of ice is stored, the lifting plate 131 may be lifted up by being supported by the elastic member 135.

On the other hand, as shown in FIG. 13B, if a large amount of ice is stored, the lifting plate 131 may descend because the elastic member 135 may not be able to support the lifting plate 131 up due to the heavy weight of the ice.

In the case that a large amount of ice is stored, as the ice is piled up from the bottom side 121*a* of the ice bucket 120*a*, the ice may reach where the auger 300 is located even if the lifting plate 131 descends, and may be transported by the auger 300.

On the contrary, in the case that a small amount of ice is stored, since the ice is piled up from the bottom side 121*a* of the ice bucket 120*a*, the ice may not reach where the auger 300 is located and thus, may not be transported by the auger 300. Accordingly, the lifting plate 131 may be arranged to be lifted in order to put the ice on a side adjacent to the auger 300.

An anti-fall projection 132 protruding (or extending) upward may be arranged along the edges of the lifting plate 131. As described above, the lifting plate 131 is supported by the elastic member in the vertical direction on the bottom side 121*a*.

As the ice falls from the ice maker 110, the ice may be broken into pieces on the ice bucket 120*a* and some of the small ice pieces may remain on the lifting plate 131, so the anti-fall projection 132 may be arranged to prevent the ice pieces from falling between the lifting plate 131 and the bottom side 121*a*.

If the ice pieces fall below the lifting plate 131, the ice may restrict lifting/descending movements of the lifting plate 131, and if the ice pieces are piled up on the bottom side 121*a* for a long period, the restriction of movement may cause sanitary issues.

The lifting plate 131 may be lifted or descended in the vertical direction under the support of the elastic member 135 depending on the weight of the ice, without being limited thereto. For example, the lifting plate 131 may lie on the bottom side 121*a* of the ice bucket 120*a* at ordinary times and be driven by an extra driving device (not shown) to be lifted while pivoting on a shaft formed on the top of the bottom side 121*a*.

An ice maker 100*b* in accordance with another embodiment of the present disclosure will now be described. The same or similar features to those of the ice maker 100 in accordance with the previous embodiment of the present disclosure will not be described again.

The refrigerator 1 may have a larger storage capacity as demanded by the user. A longer height of an ice maker room 34*b* than the height of the ice maker room 34 in accordance with the previous embodiment of the present disclosure may expand the storage capacity of the ice maker room 34*a* to store more amount of ice.

The vertical length of the ice bucket 120*b* may increase accordingly, and if the storage space of the ice bucket 120*b* is deep, a problem may arise in transporting the ice stored in the ice bucket 120*b* upward.

To solve this problem, the ice bucket 120*b* may be formed to be slanted upward as the auger 300*b* goes forward, thereby primarily transporting the ice to be moved to the blade unit 420 to a certain height.

While the ice maker 100, 100*a* in accordance with the previous embodiments primarily transports ice in the horizontal direction by the auger and then secondarily transports the ice upward, the ice maker in the present embodiment of the present disclosure may primarily transport ice not only forward but also to a certain height by the auger 300, so the ice may be transported to an even higher height.

That is, an auger shaft 310*b* may be arranged to be slanted upward to the front, and thus the ice may be slantingly moved upward along the direction in which the auger shaft 310*b* extends.

Accordingly, the ice maker 100*b* primarily transports ice stored in the ice bucket 120*b* on a slope that goes upward nearer to the front. After that, the ice may be secondarily moved further up by the blade unit 400 and then be released to the dispenser 50.

Figure 16A:
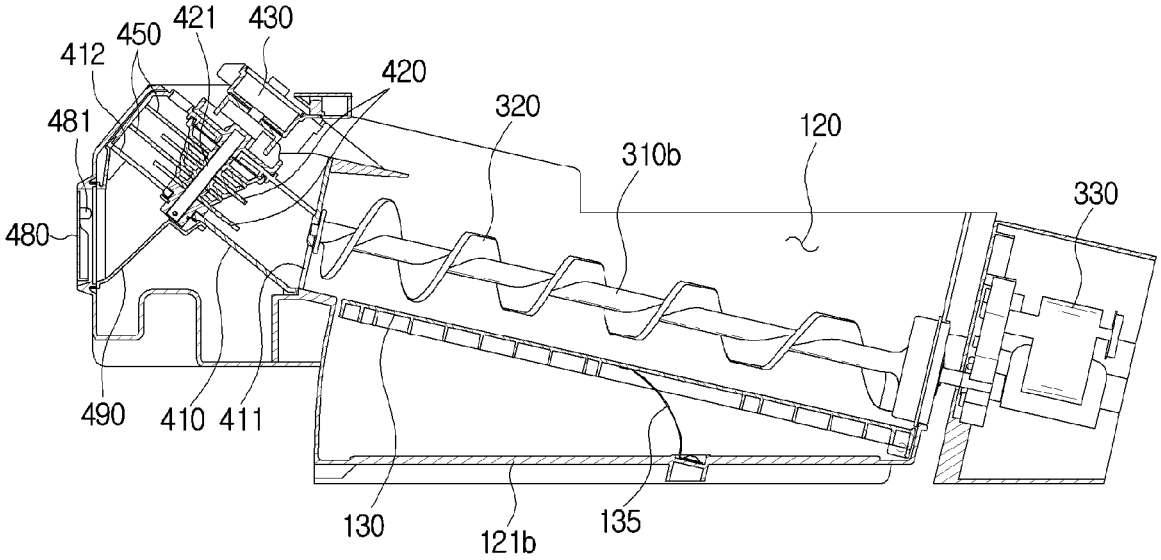
FIGS. 16A and 16B illustrate a schematic side view showing a refrigerator according to various embodiments of the present disclosure.
Figure 16B:
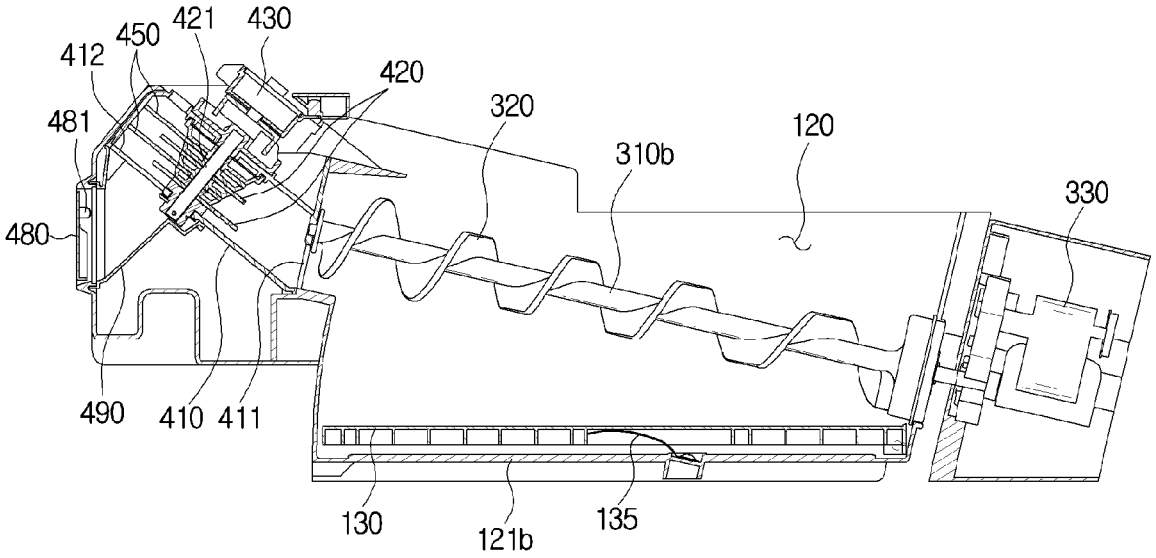

As shown in FIGS. 16A and 16B, the ice lifter 130 may be positioned such that the ice lifter 130 may be slanted upward to the front to be in parallel with the auger shaft 310*b* while being lifted. This is to move the ice forward along the auger 300*b* while the ice is positioned to be adjacent to the auger shaft 310*b* when the ice is lifted by the ice lifter 130.

When the ice lifter 130 descends due to a large amount of ice stored, the lifting plate 131 may be positioned to be parallel with the bottom side 121*b*.

According to embodiments of the present disclosure, a transporter configured to supply ice to a dispenser, at least a part of which is located above an ice bucket located in the middle of the main body, may transport ice upward to help the user take the ice conveniently even with the ice bucket located in the middle of the main body.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An ice maker assembly comprising:

an ice maker configured to form ice;

an ice bucket arranged below the ice maker and configured to store the ice formed by the ice maker; and a transporter assembly configured to transport the ice stored in the ice bucket to an outside of the ice bucket, wherein the transporter assembly comprises:

a first transporter configured to be rotationally arranged inside the ice bucket to transport the ice in a direction of a rotation shaft of the first transporter, and a second transporter including a blade configured to crush the ice transported by the first transporter by rotation, and configured to transport the ice to a top of the ice bucket as the blade rotates, wherein the second transporter is arranged to be slanted upward to the first transporter.

2. The ice maker assembly of claim 1, wherein the first and second transporters each include respective shafts configured to turn in different directions and rotate around the shafts.

3. The ice maker assembly of claim 1, wherein the blade comprises:

a first settler arranged on one side of the blade and configured to settle the ice in order for the ice to be transported to the top of the ice bucket while rotating along with the blade, and a second settler arranged on the other side of the blade and configured to settle the ice in order for the ice to be transported to the top of the ice bucket while rotating along with the blade.

4. The ice maker assembly of claim 3, wherein:

the blade is able to rotate in a direction for the ice settled in the first settler to be transported upward, and the blade is able to rotate in an opposite direction for the ice settled in the second settler to be transported upward.

5. The ice maker assembly of claim 1, wherein an angle formed between a direction in which the blade rotates and a direction in which the rotation shaft of the first transporter is arranged is between 20 to 50 degrees from a vertical direction of the ice bucket.

6. The ice maker assembly of claim 1, wherein:

the first transporter comprises a first driving motor configured to rotate the first transporter, the second transporter comprises a second driving motor configured to rotate the second transporter, and the first and second driving motors are driven independently.

7. The ice maker assembly of claim 4, wherein the second transporter comprises:

a case covering the blade, an inlet through which the ice transported by the first transporter comes, and an outlet formed at a location higher than the inlet and configured to discharge the ice.

8. The ice maker assembly of claim 7, wherein:

the second transporter comprises a fixed blade arranged in a rotation path of the opposite direction of the blade and configured to crush the ice transported in the opposite direction, and the ice transported in the opposite direction is crushed and discharged through the outlet.

9. The ice maker assembly of claim 8, wherein the case further comprises an auxiliary outlet formed for discharging the ice falling in the rotation path of the opposite direction to prevent some of the crushed ice from falling before reaching the outlet and not being discharged.

10. The ice maker assembly of claim 7, wherein a hub of a tapered form slanted toward the outlet is arranged on the rotation shaft of the blade.

11. The ice maker assembly of claim 10, wherein the hub comprises a guide plane slanted toward the outlet and configured to guide the ice transported to the outlet to be discharged through the outlet.

12. The ice maker assembly of claim 7, wherein the case further comprises a lift guide having a curved plane to guide the ice coming through the inlet to be transported upward in one direction or in an opposite direction, and arranged to be adjacent to the inlet.

13. The ice maker assembly of claim 1, further comprising an ice lifter arranged on an internal bottom of the ice bucket and configured to lift the ice stored in the ice bucket to transport the ice by the first transporter.

14. A refrigerator comprising:

a main body including an opening on a front;

a door including a dispenser and configured to open and close the opening;

an ice maker arranged inside the main body;

an ice bucket configured to store ice formed by the ice maker; and a transporter configured to transport the ice stored in the ice bucket to the dispenser, wherein the transporter comprises:

an auger configured to be rotationally arranged inside the ice bucket for transporting the stored ice along a direction of a rotation shaft of the auger, and a blade unit configured to be rotationally arranged between the auger and the dispenser for transporting the ice transported by the auger to the dispenser by rotation, the auger and the blade unit are arranged to include different rotation shafts, wherein the blade unit includes:

an inlet through which the ice transported by the auger comes, and an outlet formed at a higher location than the inlet for discharging the ice.

15. The refrigerator of claim 14, wherein the auger is configured to transport the ice in a direction perpendicular to a direction in which the auger rotates, and the blade unit is configured to transport the ice in a direction of rotation.

16. The refrigerator of claim 14, wherein the blade unit further comprises:

a blade configured to:

settle the ice stored in the ice bucket to be transported upward, and rotate along with the ice upward from a bottom of the ice bucket, and an outlet formed at a location higher than the inlet for discharging the ice.

17. The refrigerator of claim 16, wherein:

the dispenser comprises a takeout hole of an opening form formed for the ice discharged from the outlet to come into the dispenser, and the blade unit comprises a slider to link the outlet and the takeout hole for the ice discharged from the outlet to slide to the takeout hole.

18. The refrigerator of claim 17, wherein:

the slider comprises an open/close member arranged on a side adjacent to the takeout hole and configured to open or close the slider by pivoting itself, and the dispenser comprises an open/close projection protruding toward the open/close member from a bottom of the door is configured to press the open/close member to be pivoted, and the open/close projection is configured to press the open/close member to be pivoted when the door is closed, thereby opening the slider.

19. A refrigerator comprising:

a main body including an opening on a front;

a door including a dispenser and configured to open and close the opening;

an ice maker arranged inside the main body;

an ice bucket configured to store ice formed by the ice maker;

a first transporter arranged inside the ice bucket and configured to transport the ice stored in the ice bucket forward by rotation; and a second transporter arranged between the first transporter and the dispenser configured to:

move the ice transported by the first transporter to the dispenser, and move the ice stored in the ice bucket upward, wherein the second transporter comprises:

a blade arranged to be slanted upward with respect to the first transporter and configured to move the ice stored in the ice bucket upward, an inlet through which the ice transported by an auger comes, and an outlet formed at a location higher than the inlet for discharging the ice.

* * * * *